US007480207B2

(12) United States Patent
Marsh

(10) Patent No.: US 7,480,207 B2
(45) Date of Patent: Jan. 20, 2009

(54) FILTERING AND DETECTION OF TELEMETRY

(75) Inventor: Laban M. Marsh, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 335 days.

(21) Appl. No.: 11/306,906

(22) Filed: Jan. 16, 2006

(65) Prior Publication Data

US 2007/0177461 A1 Aug. 2, 2007

(51) Int. Cl.
*E21B 47/18* (2006.01)

(52) U.S. Cl. ..... 367/83; 340/854.4; 340/853.1; 340/853.7

(58) Field of Classification Search ..... 340/854.4, 340/853.1, 853.7; 367/83
See application file for complete search history.

(56) References Cited

U.S. PATENT DOCUMENTS

| | | | | |
|---|---|---|---|---|
| 4,361,895 | A | 11/1982 | Khoudari | |
| 5,274,606 | A * | 12/1993 | Drumheller et al. | 367/82 |
| 5,289,354 | A * | 2/1994 | Clayer et al. | 367/82 |
| 5,955,966 | A | 9/1999 | Jeffryes et al. | |
| 6,308,562 | B1 | 10/2001 | Abdallah et al. | |
| 6,722,450 | B2 | 4/2004 | Schultz et al. | |
| 6,741,185 | B2 * | 5/2004 | Shi et al. | 340/853.2 |
| 6,781,520 | B1 * | 8/2004 | Smith et al. | 340/853.1 |
| 6,781,521 | B1 * | 8/2004 | Gardner et al. | 340/854.4 |
| 6,788,219 | B2 | 9/2004 | Sun et al. | |
| 6,898,149 | B2 | 5/2005 | Hill et al. | |
| 6,963,290 | B2 | 11/2005 | Marsh et al. | |
| 7,170,423 | B2 * | 1/2007 | Wisler et al. | 340/853.7 |
| 2003/0016164 | A1 | 1/2003 | Finke et al. | |

FOREIGN PATENT DOCUMENTS

| | | |
|---|---|---|
| EP | 0 908 600 A2 | 4/1999 |
| WO | 2004 073240 A2 | 8/2004 |

OTHER PUBLICATIONS

Wikipedia, definition of Antenna Diversity, May 7, 2008 edition.*
Wikipedia, definition of Diversity Scheme, May 22, 2008 edition.*
International Search Report for application PCT/US2006/062394 dated Sep. 20, 2007 (2pp).

* cited by examiner

*Primary Examiner*—Albert K Wong
(74) *Attorney, Agent, or Firm*—Mark E. Scott; Conley Rose, P.C.

(57) ABSTRACT

The specification discloses systems and methods that provide improved capability to detect and decode encoded telemetry data. More particularly, the specification discloses embodiments for detecting and decoding telemetry data by receiving a plurality of waveforms comprising encoded telemetry data. A first set of outputs is detected from the encoded telemetry data using a first set of filtering and detection parameters, and a second set of outputs is detected substantially concurrently from the encoded telemetry data using a second set of filtering and detection parameters. The sets of outputs are merged to produce decoded telemetry data.

35 Claims, 15 Drawing Sheets

FILTERING AND DETECTION OF TELEMETRY

BACKGROUND

Measuring-while-drilling (MWD) and logging-while-drilling (LWD) systems gather data regarding the borehole and surrounding formations, and some of this information is most useful during the drilling process. For this reason, telemetry systems have been developed to transfer the information from downhole to the surface. One method of transferring the data from downhole to the surface is by encoding the data in pressure pulses of the drilling fluid within the drill string.

In ideal systems, each and every pressure pulse in the drilling fluid (also known as drilling mud or just mud) created downhole propagates to the surface and is detected by a pressure transducer or sensor and related electronics. However, drilling mud pressure fluctuates significantly and contains noise that tends to corrupt data transmission. There are several sources for these noise pressure fluctuations; the primary sources are: 1) bit noise; 2) torque noise; and 3) the mud pump.

Bit noise is created by vibration of the drill string during the drilling operation. As the bit moves and vibrates, bit jets where the drilling fluid exhausts can be partially or momentarily restricted, creating high frequency noise in the drilling fluid column. The industry's recent use of bi-centered drill bits has allowed for better extended reach drilling, but at the cost of higher downhole bottom assembly vibration and resultant pressure fluctuations and interference with LWD telemetry. Torque noise is generated downhole by the action of the drill bit sticking in a formation, causing the drill string to torque up. The subsequent release of the drill bit relieves the torque on the drilling string and generates a high-amplitude pressure event that is of significant duration compared to the LWD transmission. Finally, mud pumps themselves create cyclic noise as pistons within the mud pump force the drilling mud into the drill string. Aged, poorly maintained mud pumps, or pumps with a poor power source generate an inconsistent pump output. Thus, the drilling fluid pressure, upon which data is encoded, fluctuates, making pulse detection, and therefore data retrieval, difficult. Pulse detection also becomes more difficult as the distance from downhole to the surface increases because the propagated signal becomes smaller as the distance increases.

Current mud pulse telemetry systems have a set of parameters that can be adjusted and altered to optimize the data rate and telemetry accuracy of the system. Some of these parameters may control filter coefficients and others may control the system's ability to recognize and decode the telemetry signal. Some of these systems may be able to automatically monitor and change parameters while the system is operating but typically only one set of parameters can be used at a time. Accordingly, improvements in pulse detection and data retrieval are needed.

BRIEF DESCRIPTION OF THE DRAWINGS

For a detailed description of embodiments of the invention, reference will now be made to the accompanying drawings in which.

Figure 1:
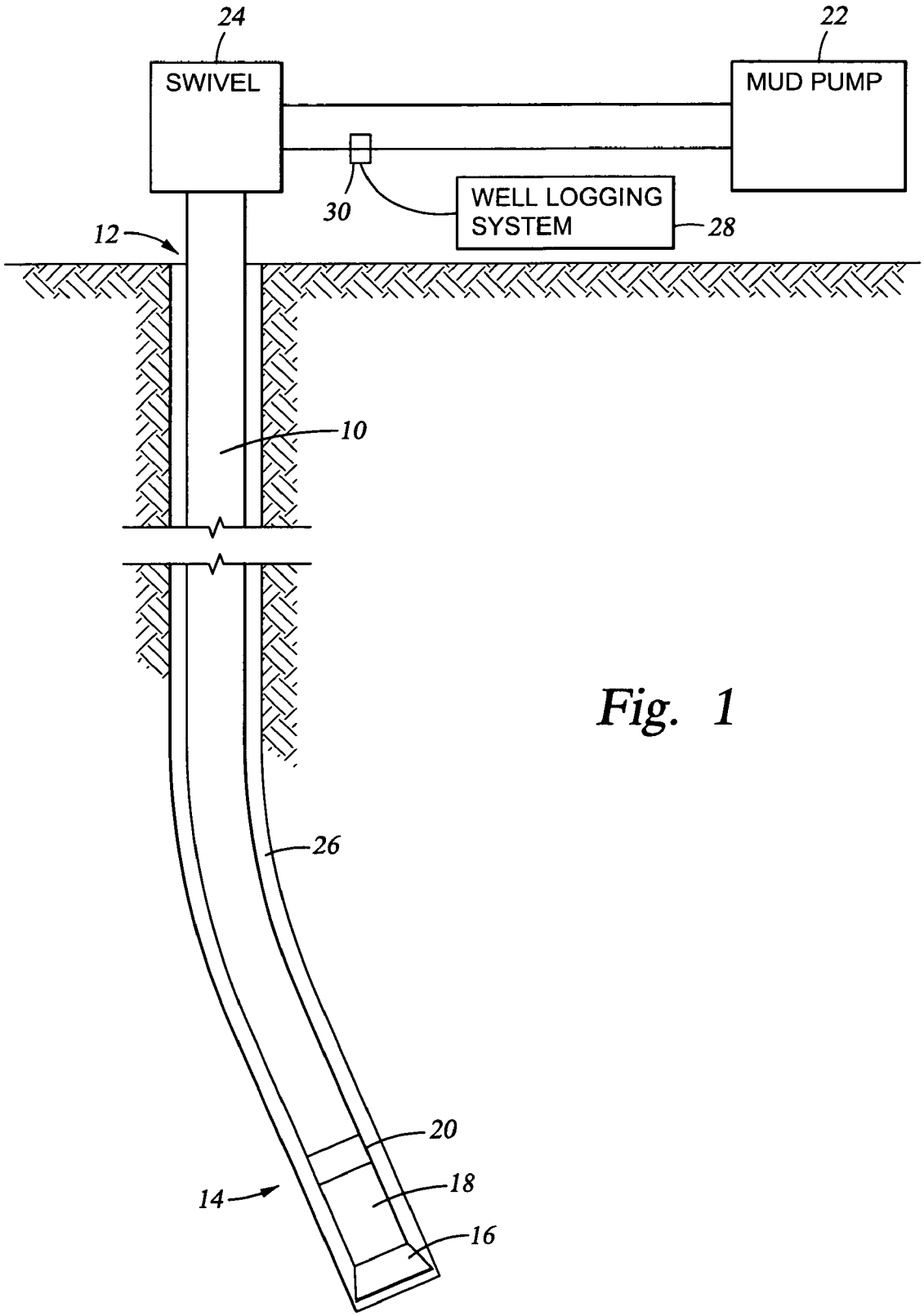
FIG. 1 shows an illustrative mud pulse telemetry system.

The drawings show illustrative invention embodiments that will be described in detail. However, the description and accompanying drawings are not intended to limit the invention to the illustrative embodiments, but to the contrary, the intention is to disclose and protect all modifications, equivalents, and alternatives falling within the spirit and scope of the appended claims.

NOTATION AND NOMENCLATURE

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Inasmuch as the systems and methods described herein were developed in the context of mud pulse telemetry, the description herein is based on a mud pulse telemetry system using pulse position modulation ("PPM") or Manchester encoding. However, the discussion of the various systems and methods in relation to a mud pulse telemetry system should not be construed as limiting the applicability of the systems and methods described herein to only PPM or Manchester mud pulse telemetry. Embodiments of these systems and methods may also be equivalently implemented for other telemetry encoding methods, for other mud pulse telemetry systems (e.g., mud siren), and for other downhole telemetry methods such as acoustic telemetry and electromagnetic telemetry.

Systems and methods are disclosed that provide improved capability to detect and decode encoded telemetry data. In some embodiments, multiple telemetry filtering and detection systems (i.e., detection engines) execute concurrently, either on one computer system or distributed across multiple computer systems. The outputs of these multiple detection engines are merged to decode the encoded telemetry data. Embodiments also allow the central configuration, monitoring, and management of the multiple filtering and detection systems. At least some embodiments include the ability to automatically perform statistical analysis of the performance of the multiple filtering and detection system to permit automatic optimization of the filtering and detection parameters of the multiple filtering and detection systems, and/or to provide a recommendation to the operator as to whether telemetry rates should be changed to optimize throughput.

FIG. 1 shows an embodiment of a drilling system having a drill string 10 disposed within a borehole 12. The drill string 10 has at its lower end a bottomhole assembly 14 which includes a drill bit 16, downhole sensors 18, and a transmitter or pulser 20. The downhole sensors 18 may include any logging-while-drilling (LWD) or measuring-while-drilling (MWD) devices. The bottomhole assembly 14 may also include systems to facilitate deviated drilling such as a mud motor with bent housing, rotary steerable systems, and the like. Moreover, the lower end of the drill string 10 may also include drill collars (not specifically shown) to assist in maintaining the weight on the bit 16. Drill string 10 is fluidly coupled to the mud pump 22 through a swivel 24. The swivel 24 allows the drilling fluid to be pumped into the drill string, even when the drillstring is rotating as part of the drilling process. After passing through bit 16, or possibly bypassing bit 16 through pulser 20, the drilling fluid returns to the surface through the annulus 26. In alternative embodiments, the bottomhole assembly 14 may mechanically and fluidly couple to the surface by way of coiled tubing; however, the methods for optimizing the filtering and detection of telemetry information transmitted from the bottomhole assembly to the surface described herein remain unchanged.

Telemetry data acquired by the downhole sensors 18 during drilling operations is transmitted to the surface by inducing pressure pulses into the drilling fluid. In some embodiments, the telemetry data is encoded using pulse position modulation. In other embodiments, the telemetry data is encoded using Manchester encoding. In further embodiments, a siren pulser device (not specifically shown) can be used to transmit phase shift encoded telemetry data.

In PPM, data is encoded in the intervals between the pressure pulses. An interval is the time duration between two pulses, determined by time measurement between the leading edges, the trailing edges, the mid-point positions, or the centroid positions. More specifically, telemetry data is encoded in a group of sequential intervals referred to as a list. Multiple types of lists may be used to transmit telemetry data, each with a specific predefined format. For example, the initial interval (or intervals) of each list may be an identifier specifying the list type. A list may include detected downhole parameters such as electromagnetic wave resistivity (e.g., an eight-bit value encoded in two four-bit intervals), a gamma ray reading (e.g., an eight-bit value encoded in two four-bit intervals), and a density value (e.g., a twelve bit value encoded in three four-bit intervals). The use of lists in mud pulse telemetry systems is described in more detail in U.S. Pat. No. 6,963,290 entitled Data Recovery for Pulse Telemetry Using Pulse Position Modulation and U.S. Pat. No. 6,788,219 entitled Structure and Method for Pulse Telemetry.

The pressure pulses are received in one or more pressure sensing devices 30. The pressures sensing devices 30 may include one or more pressure transducers and/or sensors. In the illustrative embodiments described herein, the pressure sensing devices 30 include two pressure transducers. The two transducers are located at separate locations so that each receives signals with different signal and noise characteristics. A sensor (not specifically shown) is located in the mud pump 22 to capture the rate at which the pump is running so the characteristic frequency of the pump noise can be determined. The well logging and data acquisition system 28 acquires the signals comprising the encoded data from the pressure sensing devices 30 and applies a telemetry filtering and detection method to the signals to detect the transmitted lists and extract the encoded data. The well logging and data acquisition system 28, the downhole sensors 18, and the pulser 20 have a common telemetry configuration that defines the various list formats used in embodiments of the telemetry detection and filtering methods described herein.

Figure 2:
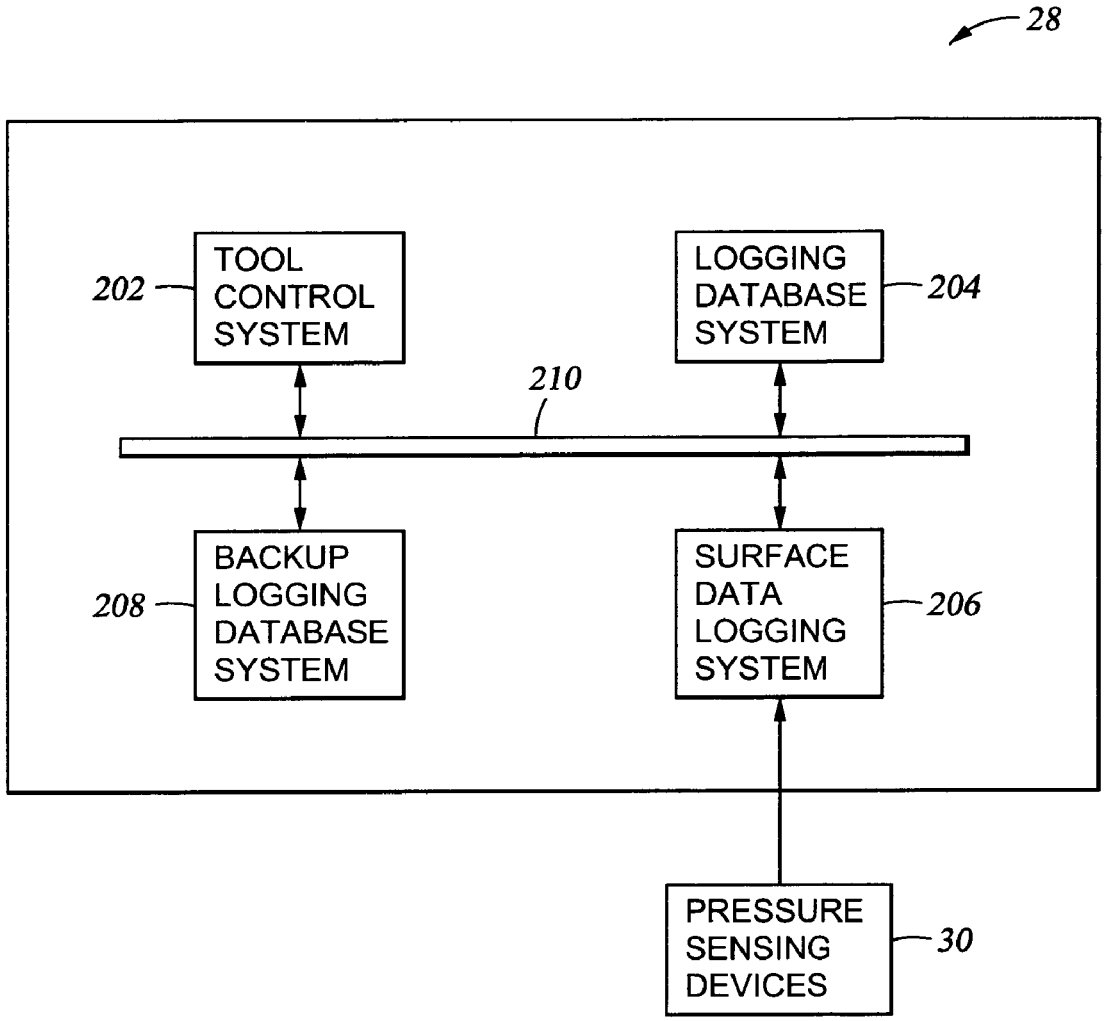
FIG. 2 shows an illustrative well logging system included in the illustrative mud pulse telemetry system of FIG. 1.

The well logging and data acquisition system 28 comprises a surface system that may include one or more systems that process and/or store the received data. FIG. 2 shows an illustrative well logging and data acquisition system 28 that is simplified for purposes of explanation. The illustrated embodiment includes four computing systems 202-206 connected to a local area network 210. The Logging Database System 204 is a network-enabled, centralized database into which logging applications on the network 210 may store their acquired and processed data, and their local application parameters. The Tool Control System 202 tests, calibrates, and configures the logging-while-drilling tools for autonomous downhole operation. The Tool Control System 202 also provides a mechanism for reading the memory contents of the logging-while-drilling tools, processing the data and storing the information in the Logging Database System 204. The Backup Logging Database 208 is a synchronized replica of the Logging Database System 204. This redundant database is used for data distribution and automatic switch-over in the event of a failure in the Logging Database System 204. The Surface Data Logging System 206 monitors and records data associated with drilling activities. The Surface Data Logging System 206 data may encompasses such values as mud flow rates, mud temperatures, pipe tension, weight-on-bit, generator power output, hole depth, bit depth, etc. A sub-component of the Surface Data Logging System 206 is the data acquired for logging-while-drilling real-time telemetry, which may be data associated with mud pressure, acoustic, or electro-magnetic telemetry methods.

As is described in more detail in relation to FIGS. 5A, 5B, 6, and 9, one or more of the computing systems 202-206 may also be configured to execute all or a portion of embodiments of the telemetry filtering and detection methods disclosed herein. In addition, one or more of the computing systems (e.g., surface data logging system 206) may be configured to receive signals that include the encoded telemetry data from the pressure sensing devices 30.

Figure 3:
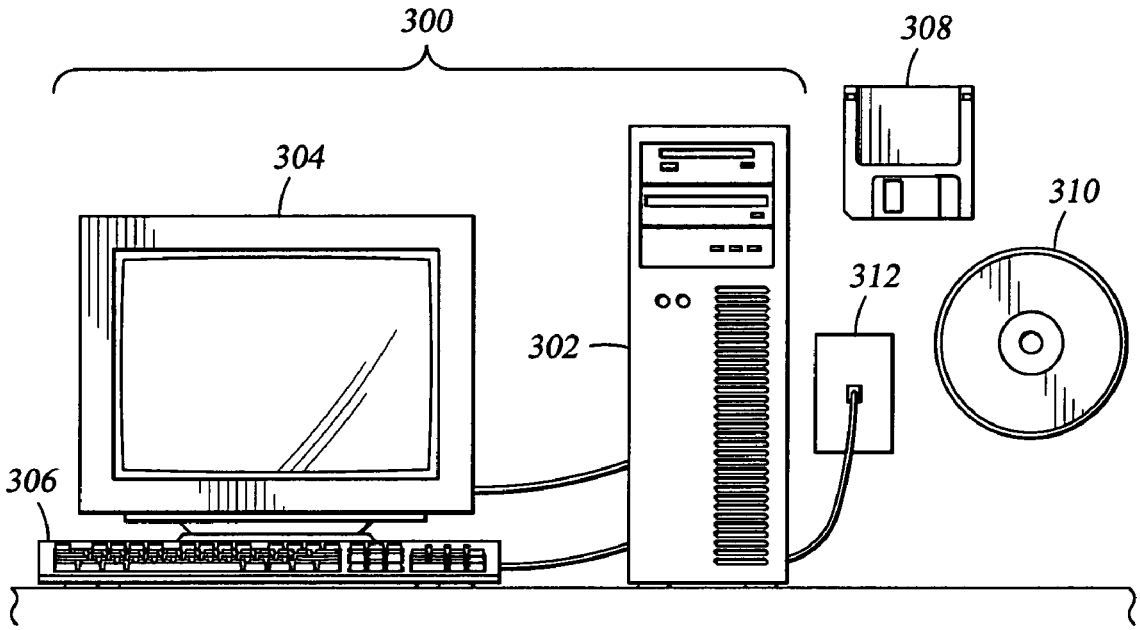
FIGS. 3 and 4 show an illustrative computing system included in the illustrative well logging system of FIG. 2.
Figure 4:
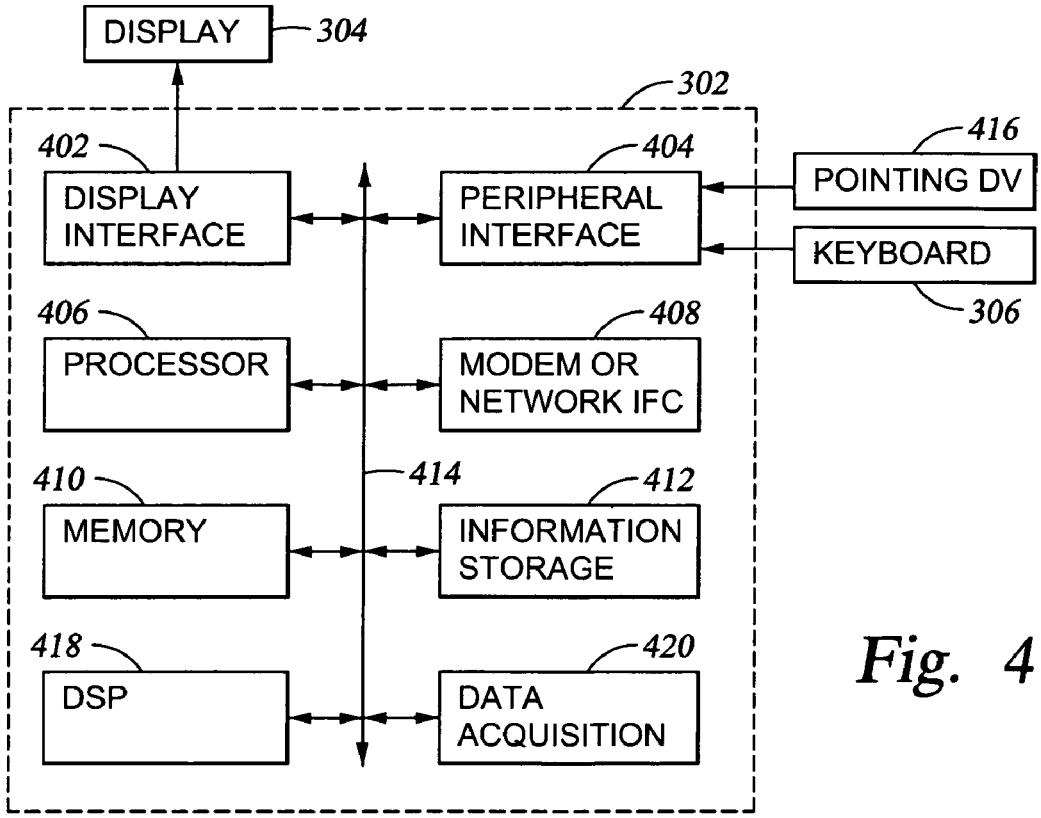

FIGS. 3 and 4 show an illustrative system configuration 300 suitable for implementing the systems 202-206. As shown, the illustrative system configuration 300 includes a chassis 302, a display 304, and an input device 306. The chassis 302 includes a processor 406, memory 410, and information storage devices 412. One or more of the information storage devices 412 may store programs and data on removable storage media such as a floppy disk 308 or an optical disc 310. The chassis 302 also includes a network interface 408 that allows the system 300 to receive information via the local area network 210 and/or a wired or wireless wide area network, represented in FIG. 3 by a phone jack 312. The information storage media and information transport media (i.e., the networks) are collectively called "information carrier media."

The chassis 302 is coupled to the display 304 and the input device 306 to interact with a user. The display 304 and the input device 306 may together operate as a user interface. The input device 306 is shown as a keyboard, but other input devices such as a mouse or a keypad may also be included.

FIG. 4 shows a simplified functional block diagram of system 300. The chassis 302 may include a display interface 402, a peripheral interface 404, a processor 406, a modem or other suitable network interface 408, a memory 410, an information storage device 412, and a bus 414. In some embodiments, the chassis 302 may also include a data acquisition interface 420 that accepts data from the pressure sensing devices 30, and a digital signal processor ("DSP") 418 for processing that data. System 300 may be a bus-based computer, with the bus 414 interconnecting the other elements and carrying communications between them. The display interface 402 may take the form of a video card or other suitable display interface that accepts information from the bus 414 and transforms it into a form suitable for the display 304. Conversely, the peripheral interface 404 may accept signals from the keyboard 306 and other input devices such as a pointing device 416, and transform them into a form suitable for communication on the bus 414.

The processor 406 gathers information from other system elements, including input data from the peripheral interface 404 and/or the data acquisition interface, and program instructions and other data from the memory 410, the information storage device 412, or from other systems coupled to the local area network 210 or a wide area network via the network interface 408. The processor 406 carries out the program instructions and processes the data accordingly. In some embodiments, the processor 406 may utilize the DSP 418 to process mud pulse telemetry data. The program instructions may further configure the processor 406 to send data to other system elements, comprising information for the user which may be communicated via the display interface 402 and the display 304.

The network interface 408 enables the processor 406 to communicate with other systems via the local area network 210 or via a wide area network. The processor 406 may send mud pulse telemetry data to these other systems for processing via these networks. The memory 410 may serve as a low-latency temporary store of information for the processor 406, and the information storage device 412 may serve as a long term (but higher latency) store of information.

The processor 406, and hence the computer 300 as a whole, operates in accordance with one or more programs stored on the information storage device 412 or received via the network interface 408. The processor 406 may copy portions of the programs into the memory 410 for faster access, and may switch between programs or carry out additional programs in response to user actuation of the input device. The additional programs may be retrieved from the storage device 412 or may be retrieved or received from other locations via the network interface 408. One or more of these programs configures system 300 to participate in the execution of the telemetry filtering and detection methods disclosed herein.

Figure 5A:
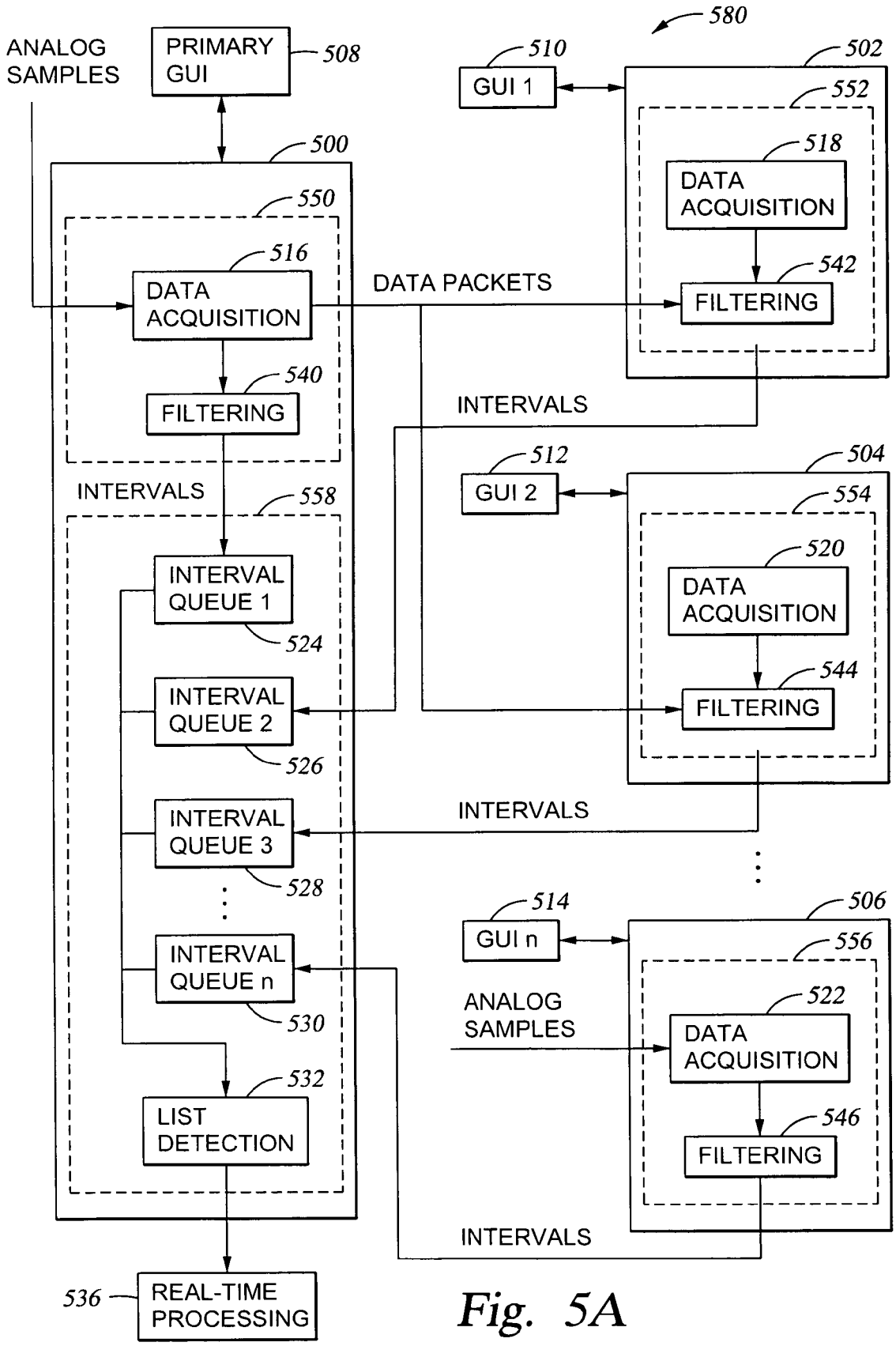
FIGS. 5A, 5B, 6, and 9 show illustrative systems for filtering and detection of mud pulse telemetry in accordance with one or more embodiments.
Figure 5B:
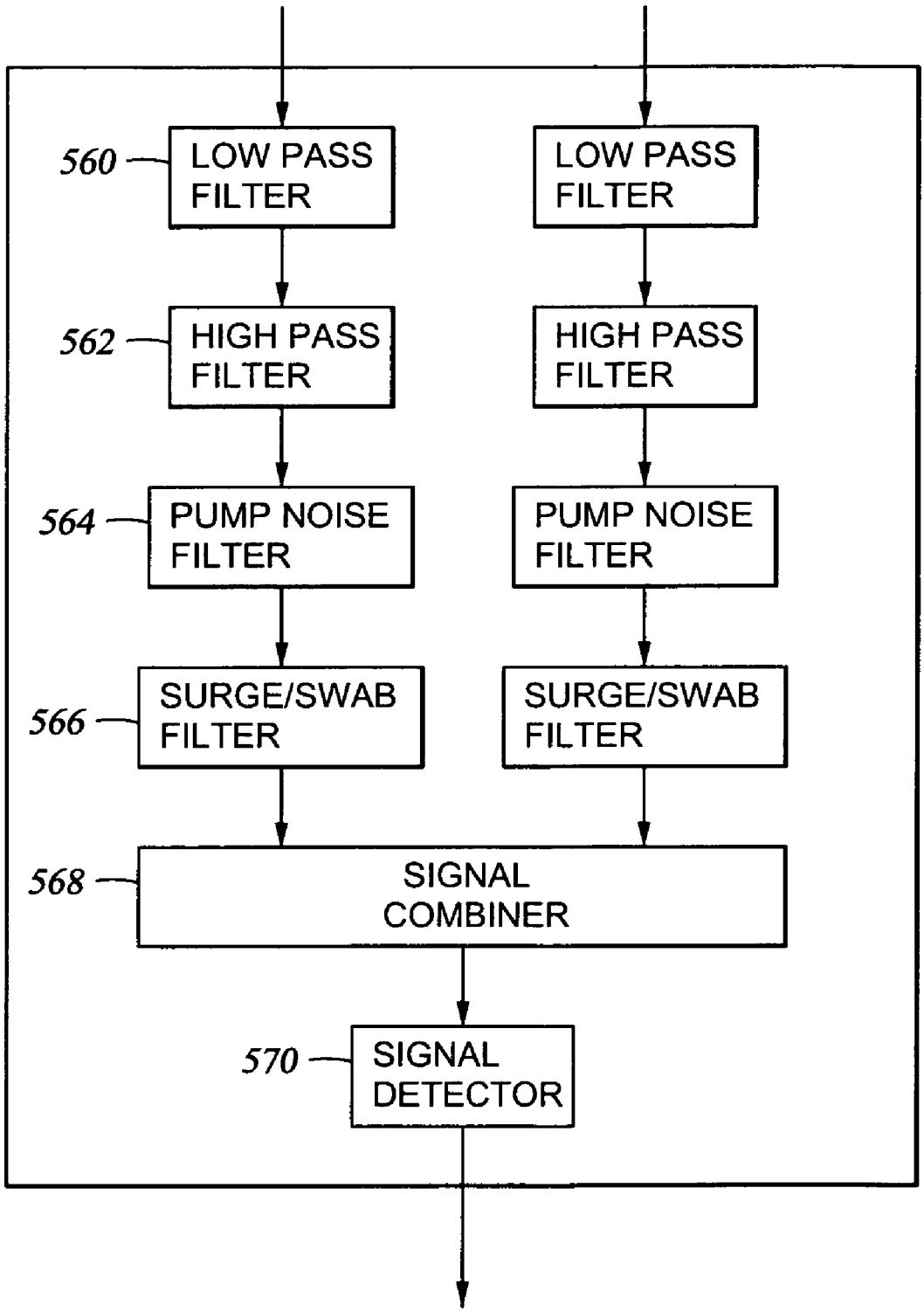
Figure 6:
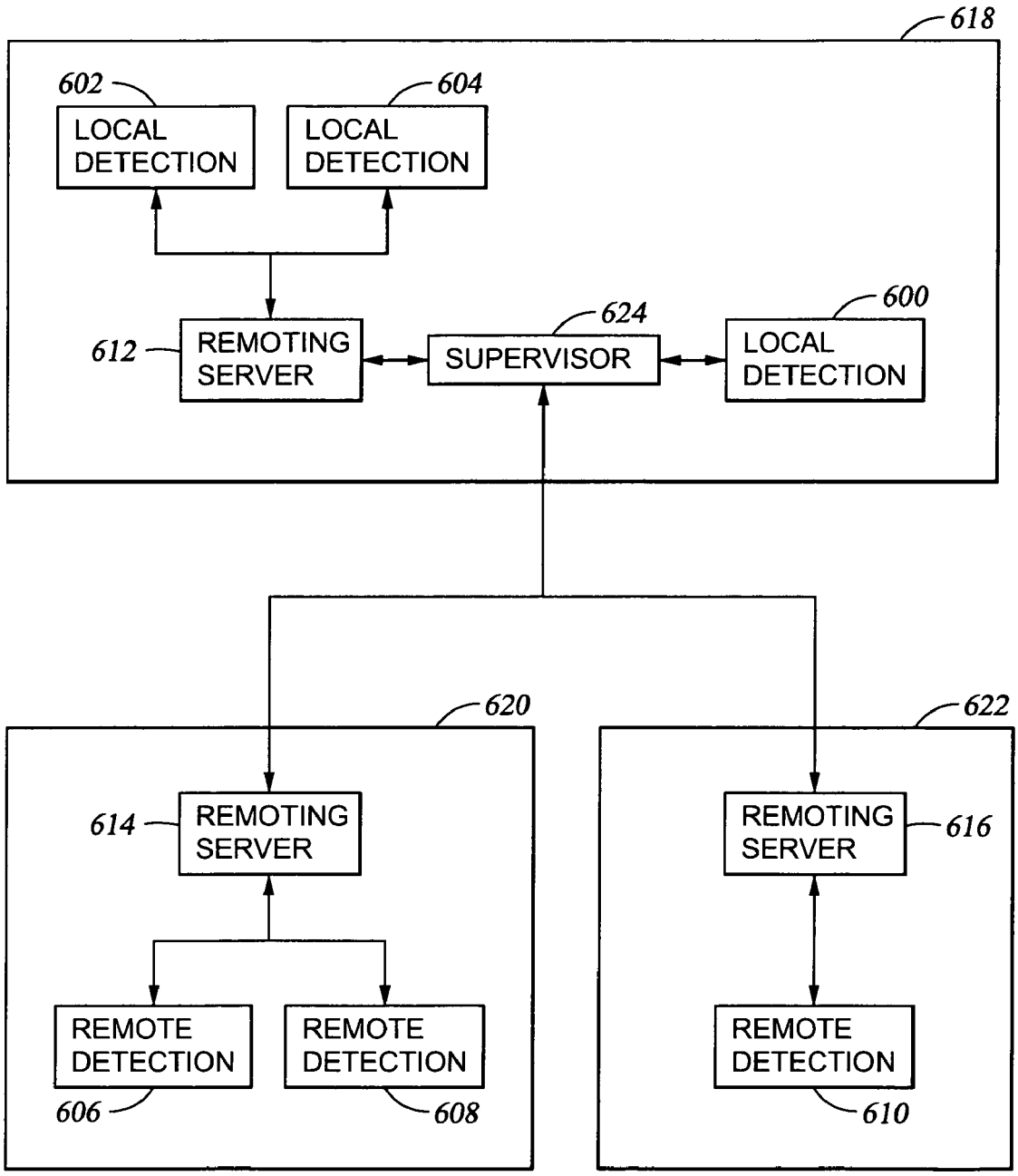

FIGS. 5A, 5B, and 6 illustrate a system 580 for detection and filtering of encoded telemetry data in accordance with one or more embodiments. The system 580 includes at least a primary detection system 500 and may include one or more secondary detection systems 502-506 in communication with the primary detection system 500. Each of the detection systems 500-506 has an associated graphical user interface ("GUI") 508-514. One or more detection engines 550-556 execute on the detection systems 500-506. Each of the detection engines 550-556 is functionally identical and includes a data acquisition subsystem 516-522 and a filtering subsystem 540-546. The primary detection system 500 also includes a supervisor subsystem 558. The supervisor subsystem 558 includes one or more interval queues 524-530 corresponding to the one or more detection engines 550-556, and a list detection subsystem 532. The system 580 also includes a real-time processing system 536.

The detection engines may execute on the same computing system or may be distributed across multiple computing systems in the well logging and data acquisition system 28 (FIG. 2). In some embodiments, the detection engines are implemented using the .NET framework available from Microsoft Corporation. The .NET framework includes a remoting framework that allows objects to interact across application domains. The remoting framework provides the infrastructure for calling methods in remote objects and returning the results. A remote object is any object that is not in the application domain of the calling object, whether the objects execute on the same computing system or different computing systems. Additional information regarding .NET and the .NET Remoting framework is available on the Microsoft web site, www.microsoft.com.

FIG. 6 shows an example embodiment of a system for detection and filtering of encoded telemetry data in which six detection engines 600-610 execute on three computing systems 618-622. In this example, three local detection engines 600-604 execute on computing system 618 (i.e., the primary detection system), two remote detection engines 606, 608 execute on computing system 620, and one remote detection engine 610 executes on computing system 622. .NET Remoting is used to establish communications between the supervisor subsystem 624 in the primary detection system 618, local detection engines 602,604 and the remote detection engines 606-610.

A remoting server (e.g., remoting servers 612-616) executes on each computing system 618-622. Each remoting server includes functionality to track the number of detection engines connected to it and to maintain an interval queue for each of those detection engines. Each detection engine includes functionality for placing a detected interval in its associated interval queue in the remoting server to which the engine is connected. The supervisor subsystem 624 includes functionality to request the detected intervals from the remoting server connected to each engine and to provide these intervals to the interval queues on the primary detection system 618.

Returning to FIG. 5A, the data acquisition subsystem 516 includes functionality to receive analog samples from the pressure sensing devices 30, convert the analog waveforms to a digital format (digitized) and to provide the digitized waveforms to the filtering functionality 540. The data acquisition subsystem 516 may also include functionality to provide packets with waveform data to the filtering subsystems of one or more of the detection engines executing on the secondary detection systems.

In various embodiments, the detection engines may be configured either to receive packets of waveforms from a data acquisition subsystem on the primary detection system or to receive analog samples directly from the pressure sensing devices via a data acquisition subsystem included in the detection engine. In addition, in some embodiments, a detection engine on a secondary detection system may be configured to receive the analog samples and provide those samples to the data acquisition system on the primary detection system. The primary detection system would then distribute packets of waveforms from the samples to the other detection engines for processing. In the illustrated embodiment, the detection engines 552 and 554 are configured to receive waveform data packets from the data acquisition subsystem 516 of the detection engine 550 on the primary detection system 500. The detection engine 556 on the secondary computing system 506 is configured to receive analog samples directly from the pressure sensing devices 30 via the data acquisition subsystem 522.

The timing of receipt of the samples in the detection engines is synchronized so that each detection engine can time tag an interval detected from the same sample with the same sample receipt time. The detection engines that receive analog samples directly from the pressure sensing devices (e.g., detection engines 550, 556) are time synchronized. That is, these detection engines receive each analog sample at the same time. In this case, an interval detected from the same sample received in each of these detection engines will be tagged with an identical time.

In some embodiments, functionality is included to ensure that the clocks on the computer systems executing the detection engines are synchronized. It is noted that computers running the Microsoft Windows operating system on a Microsoft Windows network domain have a time synchronization feature designed into the operating system. This feature keeps the computer domain members synchronized to the domain time, but an instant synchronization is only triggered when the computer time is in error from the domain controller time by greater than +/−180 seconds. However, LWD computer synchronization must be provided with subsecond resolution. In some embodiments, the computer running the database is responsible for synchronizing the network computers. This database computer knows which computers need to be synchronized, because each of these non-database computers has registered with the database to received status information via the network. In some embodiments, the computer running the database monitors its own system time, and sends a time synchronization command over the local area network when a seconds value of time makes a transition. The message is sent from the database server to each database client interface that resides on the immediate local area network. The time synchronization is performed with a default setting of every 5 minutes to eliminate the effect of computer timing drift. If the domain controller resets the time of the database server computer, a time synchronization command is sent on the next seconds unit of time transition to each of the database clients.

In other embodiments, the inaccuracies of the computer system time can be accounted for by counting the samples acquired by the data acquisition hardware. There are many data acquisition sources that have precision clock devices that have accuracies much greater than that used of a computer system. Timing accuracy can be achieved by counting samples and deriving the time from the sample count. This time derived from the sample count is attached to the sample packets that are communicated to the detection engines. This derived time is not reset by domain controller time adjustments or by database computer synchronizations. The derived sample-count time is used by the detection engines for time-tagging pulse intervals and the database computer is periodically set to the derived sample count time.

Referring again to FIG. 5A, in the detection engines that receive packets of waveforms from the primary detection system (e.g., detection engines 552, 554), the sample time between the primary detection system and the detection engines on secondary detection systems is synchronized to account for such things as transmission time and machine clock differences. In some embodiments, the primary detection system includes a time tag in each packet of samples sent to the detection engines on the secondary detection systems. This time tag includes the time when the first sample in the packet was taken. A detection engine receiving the packet uses the time tag in the packet to calculate a delay time. That is, when the receiving detection engine starts processing the packet, it calculates the delay time by subtracting the time indicated in the packet time tag from the current time. When each sample is processed in the detection engine to detect an interval, a sample time is calculated for it based on the time tag included in the packet. The delay time is subtracted from the calculated sample time to determine the time tag for the detected interval. Thus, an interval detected from a sample received in a detection engine on a secondary detection system will be tagged with the same time as an interval detected from the same sample received in a detection engine on the primary detection system.

In each of the detection engines 550-556, the received waveforms are provided to the filtering subsystems 540-546. The filtering subsystems 540-546 contain functionality to apply a series of parameterized filtering and detection algorithms to each waveform in an attempt to detect an interval. The resulting detected intervals are tagged with the receipt times of the samples from which the intervals were detected (adjusted by a delay time if needed as previously explained) and provided to the respective interval queues 524-530.

The filtering subsystems 540-546 are functionally identical. That is, the filtering subsystems 540-546 each comprise the same parameterized filtering and detection algorithms, and the algorithms are applied to the waveforms in the same order. However, and as will be discussed more below, each filtering subsystem may be configured with slightly different parameters for the filtering and detection. FIG. 5B illustrates the filtering and detection algorithms included in the filtering subsystems 540-546 and the order of application in accordance with some embodiments. For each received pressure pulse, a filtering subsystem receives a waveform, either directly or indirectly, from each of the pressure transducers in the pressure sensing devices 30 (FIG. 1). The two waveforms are first digitized by applying an anti-aliasing filter (not specifically shown). Each digitized waveform is then passed through a series of digital filters including a low pass finite impulse response ("FIR") filter 560, a high pass FIR filter 562, a pump noise reduction infinite impulse response ("IIR") filter 564, and a surge/swab IIR filter 566. The two filtered waveforms are then passed through a signal combiner filter 568 that combines the two waveforms in a way that enhances the noise rejection.

The waveform output of the signal combiner 568 is passed to a signal detector 570. For PPM encoding, the signal detector 570 examines the waveform for a set of characteristics that are indicative of a pulse. In some embodiments, the signal detector 570 monitors for the waveform for a positive pressure event of greater than a predetermined amplitude level where the time for which the event is consecutively sampled at an amplitude level greater than the predetermined amplitude level is longer in time than a predetermined minimum duration time limit and is shorter in time than a predetermined maximum duration time limit. The predetermined trigger or detection amplitude, the minimum duration time limit, and the maximum duration time limit are parameters that may be optimized to improve detection. Once the signal detector 570 identifies the occurrence of a pulse, it uses the saved position of the most recently detected pulse to determine the elapsed time (i.e., the interval time between pulses). The date and time is then used to tag the detected interval.

The resulting detected intervals (and their time tags) are provided to the interval queue 524-528 in the primary detection system 500 that corresponds to detection engine 550-556. That is, intervals detected by the filtering subsystem 540 of the detection engine 550 are provided to the interval queue 524, intervals detected by the filtering subsystem 542 of the detection engine 552 are placed in the interval queue 526, and so on.

Referring again to FIG. 5A, embodiments of the list detection subsystem 532 include functionality to merge the outputs of the detection engines (i.e., the detected intervals) to decode lists and to collect performance statistics on each of the detection engines. Functionality in the list detection subsystem 532 monitors each of the interval queues 524-530. As intervals are received in the interval queues, the list detection subsystem 532 applies list detection algorithms to determine whether the intervals comprise a valid list (i.e., to decode a list). Examples of such list detection algorithms are described in U.S. Pat. No. 6,963,290 entitled "Data Recovery for Pulse Telemetry Using Pulse Position Modulation" and U.S. Pat. No. 6,788,219 entitled "Structure and Method for Pulse Telemetry".

As is explained in more detail in the '290 and '219 patents, the formats of the lists (i.e., the types of lists and the number and sizes of the intervals in a given list type) are known as well as the order in which the lists are to be received. Some number of parity bits may be included in each list to allow a determination as to whether bit errors have occurred during transmission. Provision is made to allow for the insertion of an intermittently transmitted list in the expected order as well. An intermittent list is of a different type than those lists included in the expected ordering. The list detection algorithms are applied to analyze detected intervals in an attempt to decode an expected list or an intermittent list. If a number of intervals is detected that corresponds to the number of intervals contained in the expected or an intermittent list type and a valid list cannot be successfully decoded from those intervals, error recovery algorithms may be applied to decode a valid list from those intervals.

In some embodiments, the list detection subsystem 532 merges the outputs of the detection engines 550-556 by applying the list detection algorithms concurrently on a per interval queue basis and using an arbitration algorithm to select lists to be sent to the real-time processing subsystem 536. That is, the list detection subsystem 532 concurrently attempts to decode a list from the intervals received in interval queue 524, from the intervals received in interval queue 526, and so on. An arbitration algorithm, such as those described in more detail herein, is then applied to the resulting lists.

In other embodiments, the list detection subsystem 532 may merge the outputs of the detection engines 550-556 by applying the list detection algorithms to all of the interval queues in combination. That is, rather than attempting to decode a list from each interval queue, the list detection subsystem 532 combines the intervals received in all of the interval queues 524-530 to decode a list. This combining approach to decoding allows the list detection subsystem 532 to handle cases where one or more detection engines may fail to detect an interval in the anticipated list. For example, consider a system with two detection engines. If a list includes eight intervals numbered 1-8, one detection engine may detect intervals 1-3 and 5-8, but fail to detect interval 4. Another detection engine may detect intervals 1-4 and 6-8, but fail to detect interval 5. Thus, the anticipated list cannot be decoded from the intervals detected by either engine alone. However, using the combining approach, the list detection subsystem can combine the results of both detection engines to receive the full set of intervals and decode the anticipated list.

In other embodiments, the list detection subsystem 532 may use both of these approaches to list decoding.

In some embodiments, there may be cases where lists are decoded out of order because various network and computer operating conditions may cause time delays in the transmission and processing of data. In at least some of such embodiments, the list detection subsystem 532 applies an arbitration algorithm to a successfully decoded list to determine if that list has or has not already been sent to the real-time processing subsystem 536. This arbitration process ensures that only one copy of the decoded list is sent to the real-time processing subsystem 536. In some of these embodiments, the list detection subsystem 532 stores a predetermined number of the most recent lists decoded from each of the interval queues 524-530, and a predetermined number of the most recent lists provided to the real-time processing subsystem 540. For example, the list detection subsystem 532 may store the last two thousand lists decoded from each interval queue and the last two thousand lists sent to the real-time processing subsystem 536. When a list is decoded from an interval queue, the arbitration algorithm compares the start and end times of the decoded list (i.e., the time tags of the first interval and the last interval in the list) with the start and end times of the lists that have already been sent to the real-time processing subsystem 536. If there is no time overlap, the list is sent to the real-time processing subsystem 536 and is stored with the lists that have been sent for processing. If there is a time overlap, the list is rejected by the arbitration algorithm because the list has already been detected in another interval queue and sent to the real-time processing subsystem 536.

In some embodiments, the arbitration algorithm may include functionality to handle the case where a decoded list is incorrect but the error detection method used, e.g., parity bits or a checksum, did not detect the problem. This may happen when the bits allocated for parity or a checksum are too few to permit complete data verification. The arbitration algorithm may wait some predetermined period of time to receive lists decoded from each of the interval queues. The algorithm will then check for consistent results from all of the interval queues. If the results are consistent, one of the decoded lists is selected to be sent to the real-time processing subsystem 536. If the results are not consistent, a selection method may be used to choose a possibly correct list. In some embodiments, this selection method may be a voting scheme in which the list that was decoded from a majority of the interval queues is selected. This selected list is then sent to the real-time processing subsystem 536. In other embodiments, the selection method may be a weighting scheme in which a confidence factor is assigned to each detection engine. The list with the highest aggregate confidence factor is selected to be sent to the real-time processing subsystem 536.

The list detection subsystem 532 also contains functionality to generate and/or store statistical information regarding the performance of the detection engines 550-556. In some embodiments, the list detection subsystem 532 records for each detection engine at least the total number of intervals detected (i.e., the number of intervals received in the interval queue associated with a detection engine), the number of intervals successfully decoded into lists, and the percentage of intervals successfully decoded into lists. These performance statistics may be displayed using the graphical user interface 508.

The real-time processing subsystem 536 contains functionality to convert raw tool data values in the decoded lists into derived engineering parameters. The real-time processing subsystem tracks tool depths and processes data as it becomes available. For example, the phase angle measurement of the electromagnetic-wave resistivity tool can be processed into a formation resistance "ohms" value, but the value is much more accurate after the borehole diameter has been acquired. The real-time processing subsystem 536 applies environmental corrections to data as it becomes available, and writes the information into the Logging Database System 204. The real-time processing subsystem 536 also interrogates the Logging Database System 204 to obtain all the necessary parameters required to derive a parameter such as water saturation.

Referring again to FIG. 5A, in some embodiments, the graphical user interfaces ("GUI") 508-514 are an integral part of each detection system 500-506. Thus, when the detection system application is running, the GUI is present on a computer monitor of the computer system executing the application, at least as a minimized icon. In other embodiments, the detection systems 500-506 are separate and distinct applications from the GUI 508-514. In such embodiments, the detection system 500-506 may operate as a application without a user-interface or, as common referred to when running on the Microsoft Windows operating system, as a background service. Each GUI application may communicate parameters and settings to the background detection system application through any of several mechanisms, such as registry settings, contents of a file, shared-memory, named pipe communications, or TCP/IP (Transmission Control Protocol/Internet Protocol) communications. In some such embodiments, one mechanism may be used for a primary communications mode, and provision is made for communications fail-over to a secondary mode if the primary one fails.

In other embodiments, the secondary GUIs 510-514 are not present. Instead, the primary GUI 508 can be attached via named pipe or TCP/IP communication to the remote secondary detection system applications 502-506. In yet other embodiments, multiple instances of graphical user interface 508 may be invoked on the primary computer to attach to enabled secondary detection systems 502-506.

In some embodiments, the graphical user interface 508 on the primary detection system 500 presents a real-time display of the detection statistics from all of the detection engines. These statistics may be computed by the primary detection system due to its access to the interval queues for all detection systems. These detection statistics may be communicated to any graphical user interface for presentation by periodically storing the information in a shared database. In other embodiments, the statistical information is broadcast on the network as it changes to any detection system 502-506 that wants it. This broadcast to the detection system 502-506 may be implemented using various communication methods such as UDP (User Datagram Protocol), TCP/IP, or named pipe.

Referring again to FIG. 5A, in some embodiments, the network of parallel detection engines (e.g., detection engines 550-556) may be manually configured and controlled by an operator using the GUIs 508-514. The primary graphical user interface ("GUI") 508 includes graphical dialogs for manual configuration and control of a network of detection engines. The secondary GUIs 510-514 may also include these graphical dialogs, but only a subset of the functionality may be used as is further explained herein. The functionality of the GUIs 508-514 in accordance with some embodiments is explained by way of example below in reference to FIGS. 7A-7I. The ordering of the use of the GUI dialogs in this example is selected merely for ease of explanation. Other orders of use, appearance, and associated functionality of the GUI dialogs may be equivalently used.

Figure 7A:
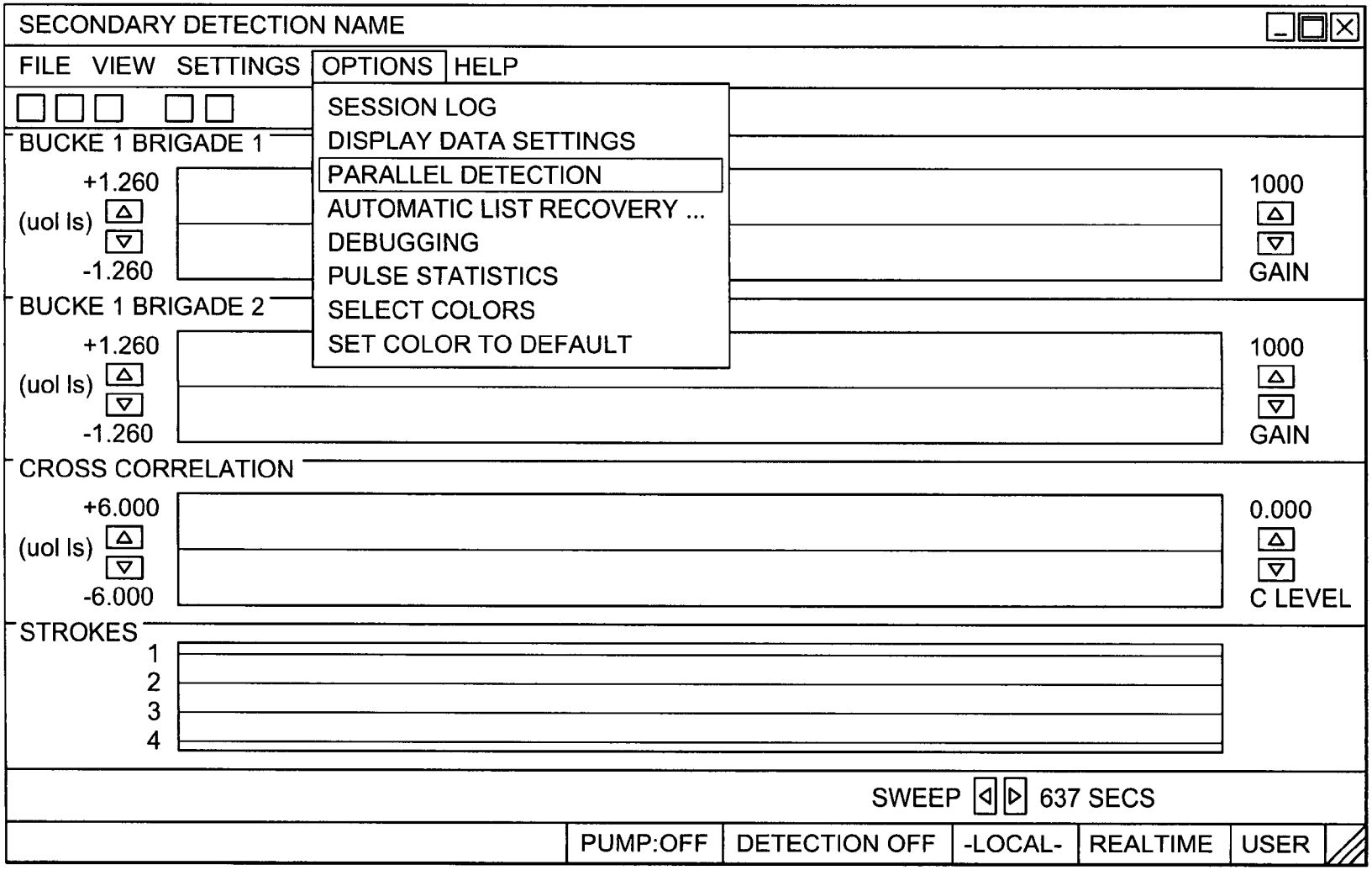
FIGS. 7A-7I show an illustrative graphical user interface for configuring a system for filtering and detection of mud pulse telemetry.
Figure 7B:
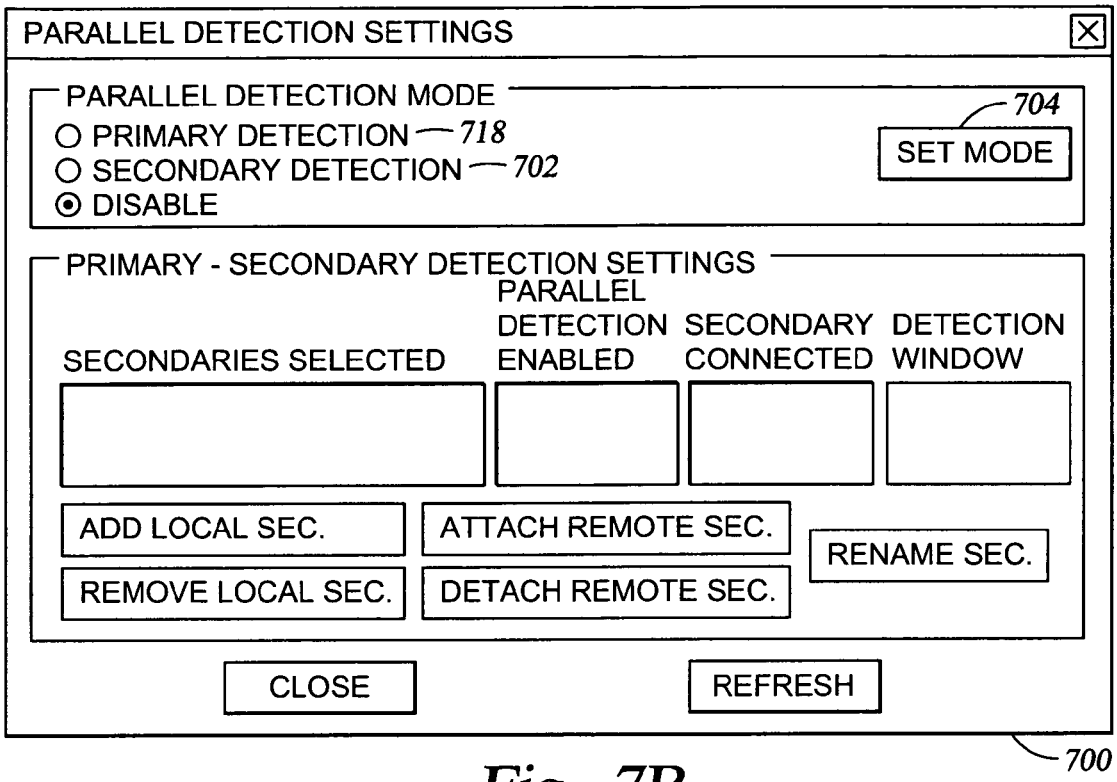
Figure 7C:
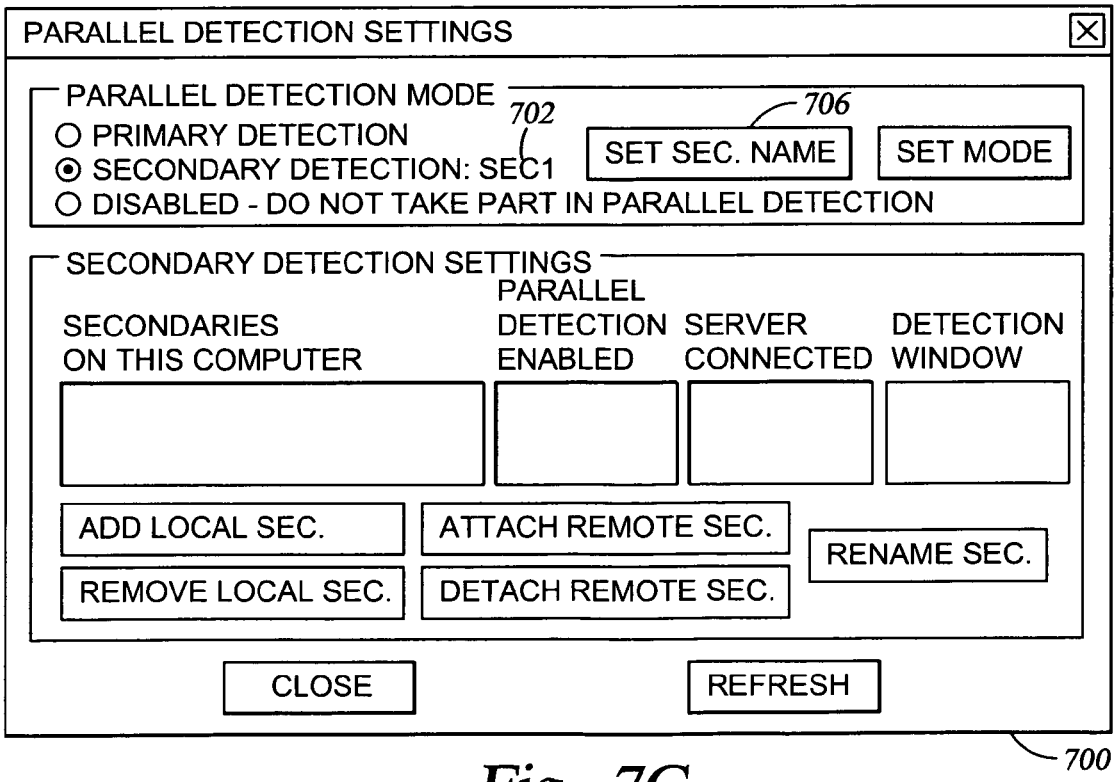
Figure 7D:
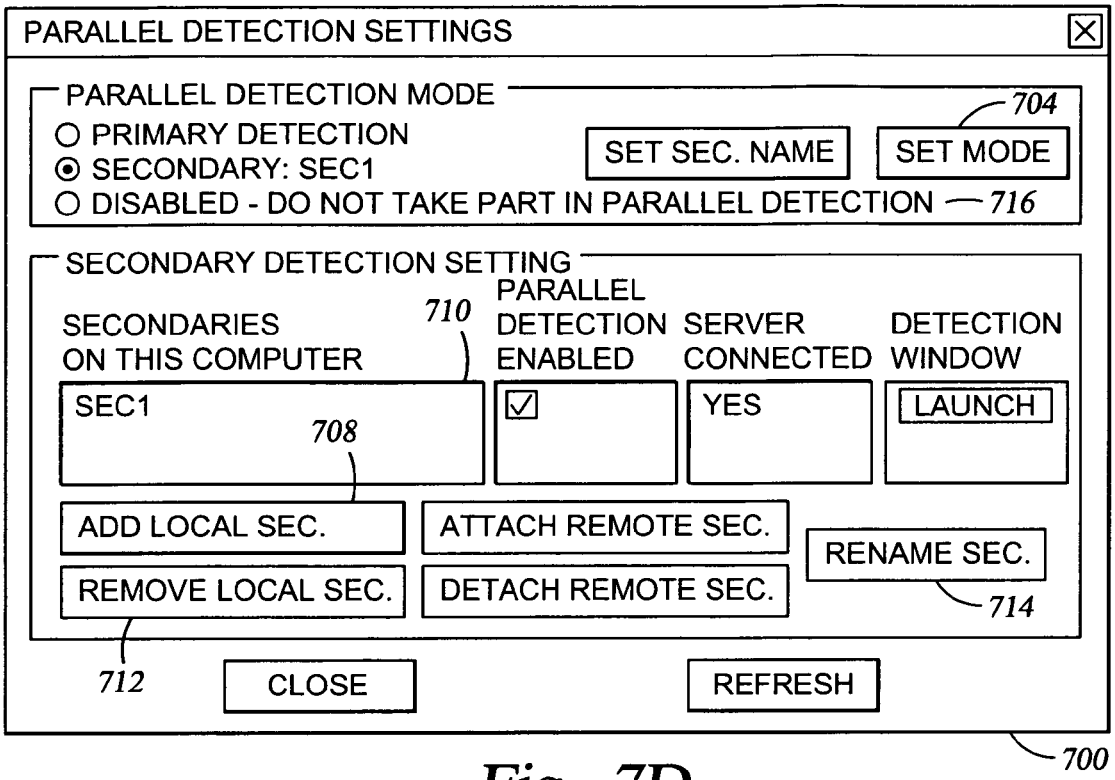
Figure 7E:
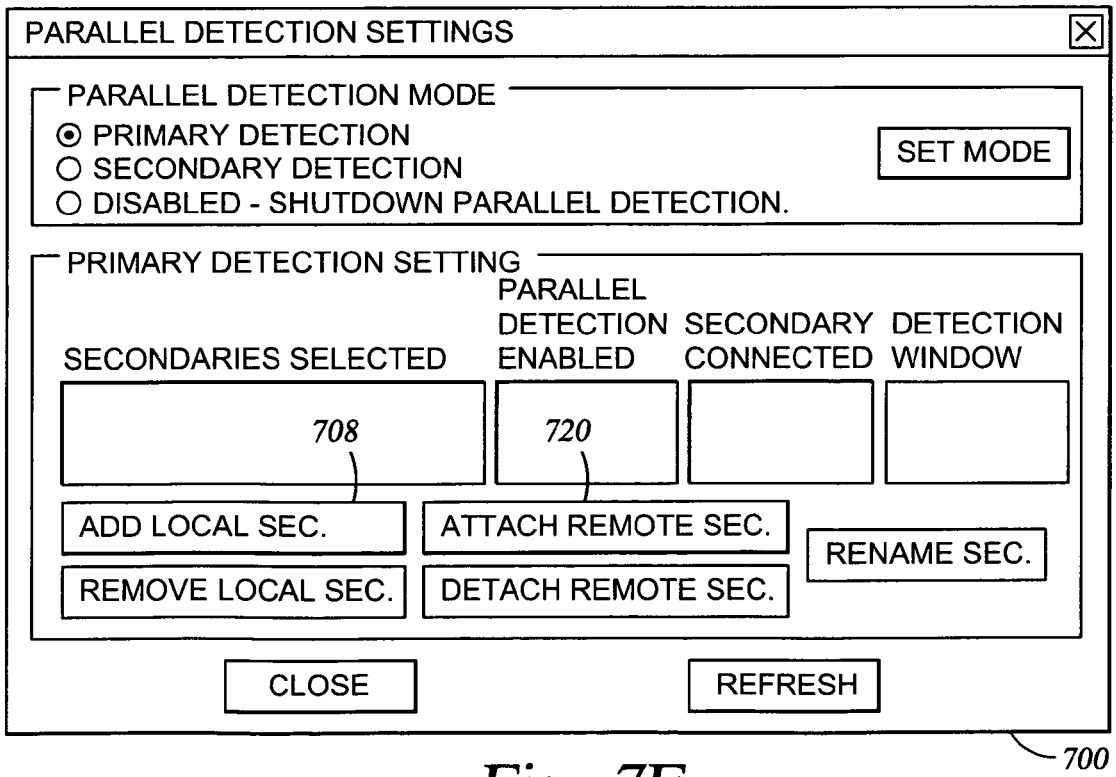
Figure 7F:
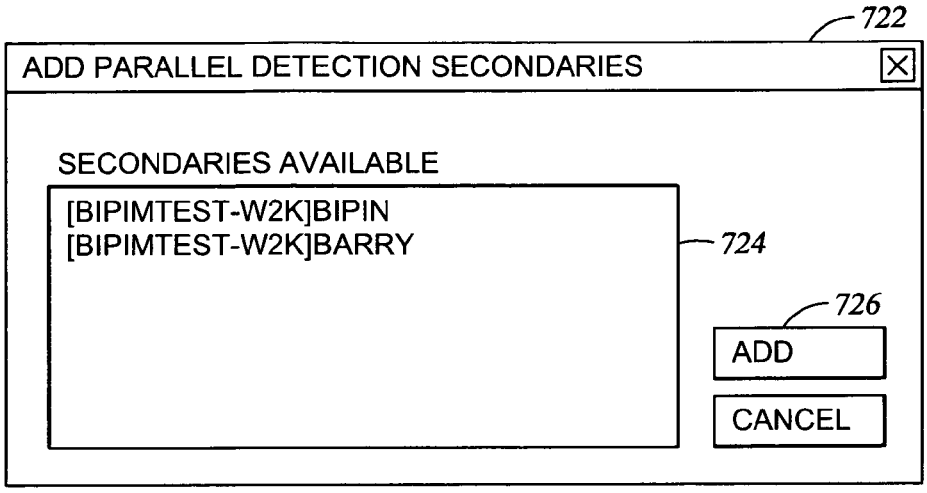
Figure 7G:
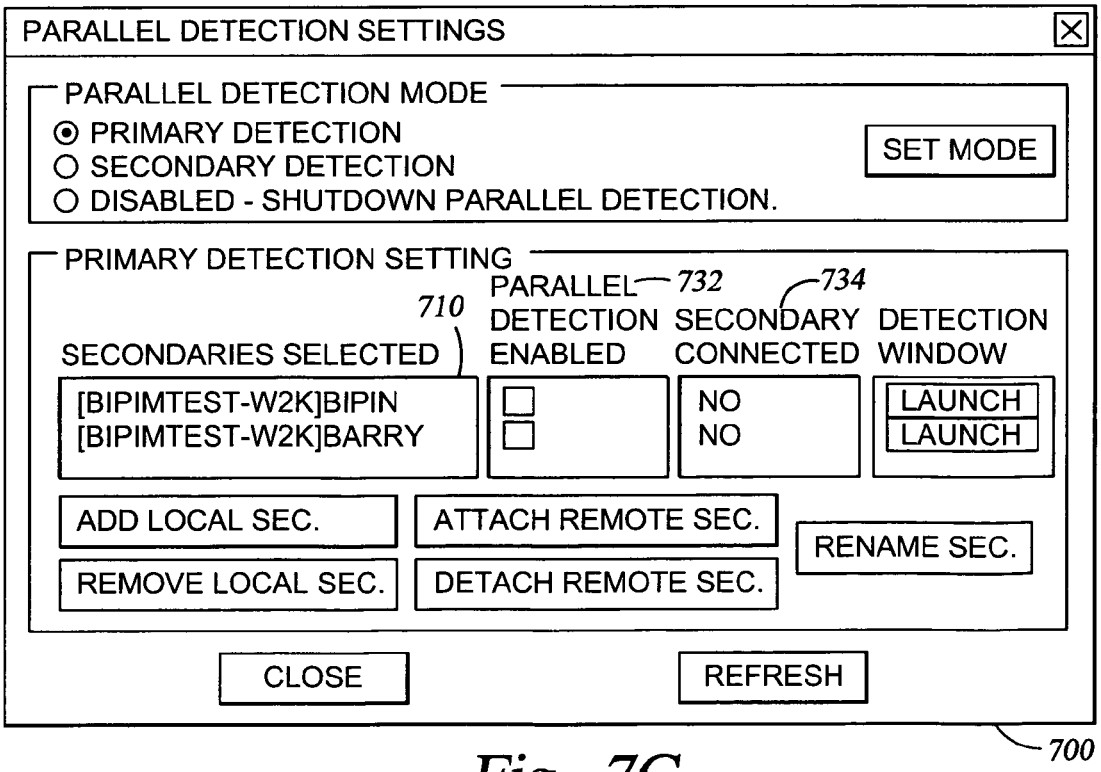

To set up a network of detection engines, an operator starts a detection application on each computing system that is to be used. Starting a detection application causes a detection engine to be activated on each computing system. In the example of FIG. 6, the operator starts a detection application on each of the computing systems 618-622. After starting a detection application, the operator may then use the graphical user interface (e.g., GUIs 508-514) on each of the computing systems to configure detection engines. The configuration process is illustrated in FIGS. 7A-7I. At each of the secondary computing systems (e.g., computing systems 620, 622 of FIG. 6), the operator first enables parallel detection as illustrated in FIG. 7A. Selecting the parallel detection option causes dialog 700 (FIG. 7B) to be displayed. Using the dialog 700, the operator selects the Secondary Detection option 702 and clicks on the Set Mode button 704 to specify that this computing system is a secondary detection system and any detection engine that executes on the computing system is a remote detection engine.

After the operator clicks on the Set Mode button 704, the dialog 700 is updated (FIG. 7C) to display the default name of the detection engine running on the computing system adjacent to the Secondary Detection option 702. A Set Sec. Name button 706 is also displayed for optionally changing the name assigned to this remote detection engine. The operator may change the default name assigned to the remote detection engine by clicking on the button 706. If the operator clicks on the Set Sec. Name button 706, a dialog (not specifically shown) is presented to allow the operator to type in the new name.

After a computing system is configured to be a secondary detection system, the dialog 700 (FIG. 7D) is updated to enable the Add Local Sec. button 708. The operator may start additional remote detection engines on the computing system by clicking on this button 708. In the example of FIG. 6, the operator would start remote detection engine 608 on computing system 620 using this option.

Note that pane 710 displays the names of the detection engines currently started on the computing system. If the operator selects the name of a detection engine in pane 710, the Remove Local Sec. button 712 and the Rename Sec. button 714 are activated. The operator may click on the Remove Local Sec. button 712 to deactivate the selected detection engine, or on the Rename Sec. button 714 to change the name of the selected detection engine. The operator may also disable the selected detection engine by selecting the Disabled option 716 and clicking on the Set Mode button.

The operator configures the primary detection system in a similar fashion. At the computing system to be designated as the primary detection system, the operator enables parallel detection as illustrated in FIG. 7A. Selecting the parallel detection option causes dialog 700 (FIG. 7B) to be displayed. Using the dialog 700, the operator specifies that this computing system is to be the primary detection system by selecting the Primary Detection option 718 and then clicking on the Set Mode button 704.

After the operator clicks on the Set Mode button 704, the dialog 700 is updated (FIG. 7E) to activate the Add Local Sec. button 708 and the Attach Remote Sec. button 720. The operator may start additional local detection engines on the primary computing system by clicking on the Add Local Sec. button 708. If the operator clicks on the button 708, a dialog 728 (FIG. 7I) is displayed. The operator may then specify a name for the new local detection engine and click on the OK button 730 to automatically launch the new local detection engine. In the example of FIG. 6, the operator would start local detection engines 602 and 604 on the primary detection system 618 using this option.

Once the primary detection system is configured, the operator may select the detection engines to be used for parallel detection by clicking on the Attach Remote Sec. button 720. Clicking on the button 720 causes a dialog 722 (FIG. 7F) to be displayed. The dialog 722 presents a pane 724 containing a list of the available remote detection engines. The operator may select one or more of the remote detection engines in this list and click on the Add button 726 to add the selected remote detection engines to the parallel detection network. The dialog 700 (FIG. 7G) is then updated to display a list of the selected remote detection engines in the pane 710. The pane 710 would also list the local detection engines if any have been started. The status of each detection engine displayed in the pane 710 is shown in the status panes 732 and 734.

Figure 7H:
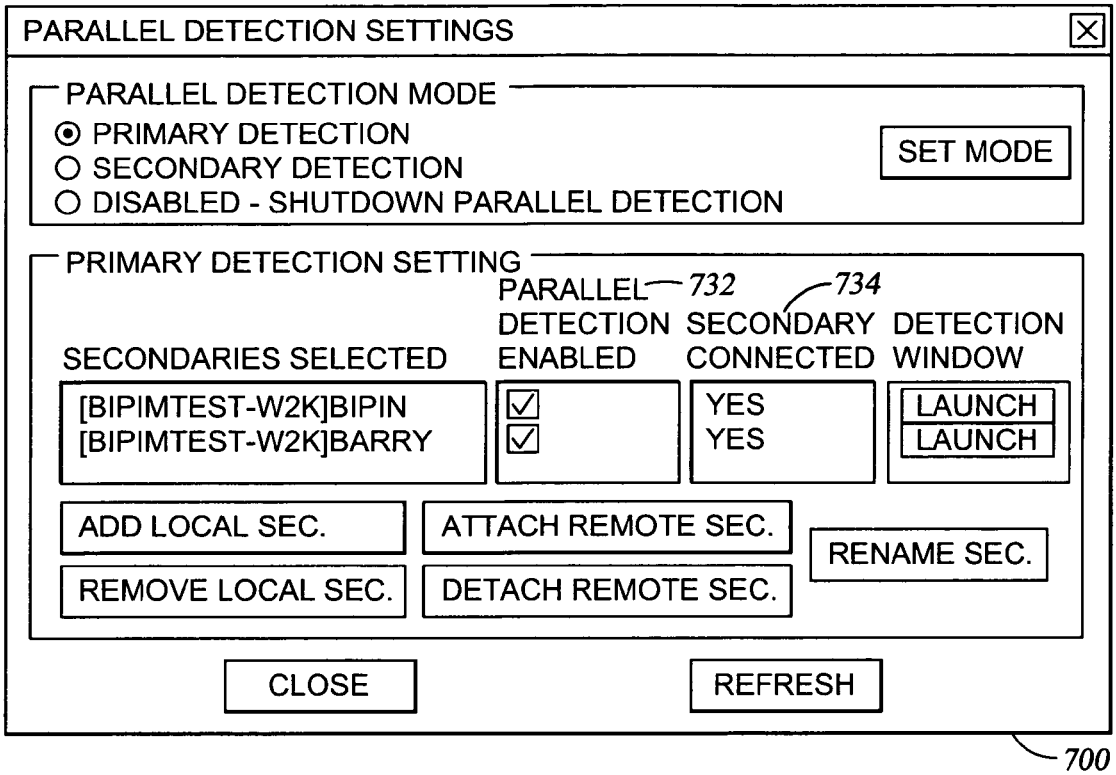
Figure 7I:
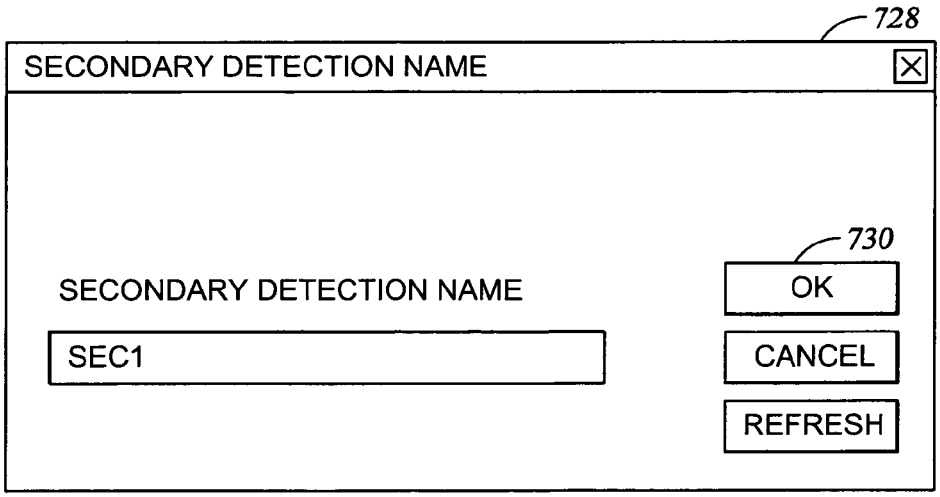

The dialog 700 in FIG. 7H exemplifies the case where the selected detection engines have not yet been enabled, as is indicated in the status panes 732 and 734. The operator must enable these detection engines using the process described above before they can be used in the parallel detection network. Once the operator has enabled the detection engines, the status columns 732 and 734 are updated as shown in dialog 700 of FIG. 7H. The status column 732 indicates whether or not parallel detection is enabled on the associated remote detection system. The status column 734 indicates whether or not the network communications connection between the primary detection system and the associated secondary detection system is good.

Once a remote detection system is enabled, the operator may access the GUI of that remote detection system on the primary detection system. The operator accesses the GUI by clicking on the Launch button in the Detection Window column 736 associated with the remote detection engine (FIG. 7H). The operator may then use this launched GUI to modify the filter and detection parameters of the remote detection engine. In some embodiments, the filter and detection parameters of the remote detection engines may only be changed using the associated launched GUI on the primary detection system. The operator may use the same dialogs in the primary detection system GUI 508 to modify the filter and detection parameters of the detection engines running on the primary detection system.

To optimize telemetry, the operator initially configures each detection engine so that at least some of the filtering and detection parameters are different in each detection engine. The operator may also configure the detection engines to use data from different transducer sources. As the system 580 operates, the operator may monitor the detection performance of the detection engines by displaying performance statistics. The operator may change the filtering and detection parameters of one or more of the detection engines to optimize telemetry in response to changing drilling conditions (e.g., increasing density and/or viscosity of the drilling fluid, increasing depth, or changes in the propagation speed of the wave shape through the drilling fluid).

In at least one embodiment, the operator may initialize the detection engines from a database by choosing sets of parameters that were successful in previous jobs that used similar mud fluids, hole geometries, bottom-hole-assembly configurations, well formation properties, etc. In other embodiments, the operator may initialize the parameters of the different detection engines to optimize detection for specific drilling activities, such has normal drilling, high weight-on-bit, circulating, steering the hole with a tight turn, reaming the hole, etc. In yet other embodiments, the operator may initially configure a selected detection engine (i.e., the primary detection engine) with the filtering and detection parameters that are considered to be most optimal. The operator then executes an initialization routine, which derives parameters for the other detection engines (i.e., the secondary detection engines). The operator then configures the secondary detection engines with the derived parameters. The parameters may be derived by changing selected parameters by delta percentages in such a way as to equally distribute the parameter settings of the secondary detection engines around those of the primary detection engine. In various embodiments, the operator may choose which parameters to use in the initialization process by checking items on a parameter selection screen. In other embodiments, the number of parameters utilized and the percentage of parameter values changed may be proportional to the availability of secondary detection engines. In such embodiments, the number and distribution of the changes is more conservative when fewer secondary detection engines are available.

Returning to FIG. 5A, in some embodiments, the supervisor subsystem 558 automatically configures and controls the network of detection engines. In these embodiments, the supervisor system determines the filtering and detection parameters that define the boundary condition for a minimum performance level (e.g., detection of 90% of the lists). The supervisor subsystem 558 may add and/or remove detection engines from the network as needed to make the determination. The supervisor subsystem 558 also assigns the initial filter and detection parameters to the detection engines in the network. As the system 580 operates, the supervisor subsystem 558 monitors the detection performance of the detection engines, and automatically adapts the filtering and detection parameters of one or more of the detection engines to optimize telemetry in response to changing drilling conditions.

Figure 8A:
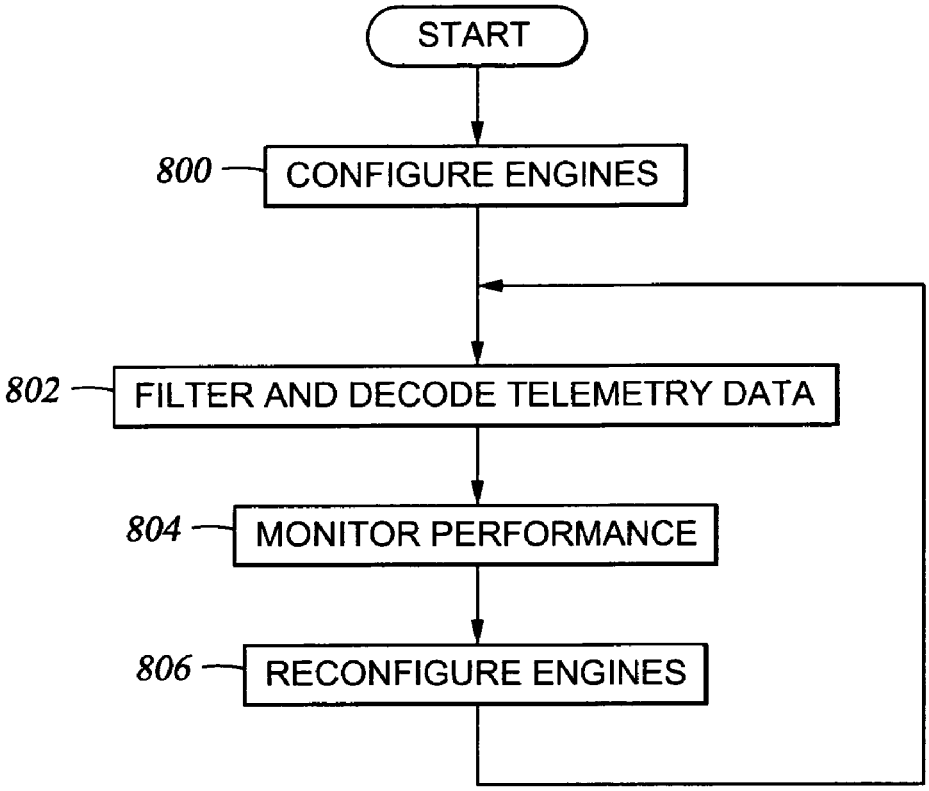
FIGS. 8A-8D show illustrative methods for automatically adapting filtering and detection of mud pulse telemetry in accordance with one or more embodiments.

FIG. 8A illustrates a method the supervisor subsystem 558 may use for adapting filtering and detection parameters in one or more embodiments. Although the actions of this method are presented and described serially, the order may differ and/or some of the actions may occur in parallel without departing from the scope and spirit of invention. For purposes of explanation, assume that there are N filtering and detection parameters for each detection engine. With this assumption, the parameters will range in an N-dimensional space. The supervisor subsystem 558 first configures the filtering and detection parameters of each detection engine (block 800). The supervisor subsystem 558 selects one of the detection engines to configure with a base set of values for the N filtering and detection parameters, which for purposes of explanation is designated the MAIN set. The supervisor subsystem 558 then configures the other detection engines with parameters that differ from the MAIN set by only a positive or negative increment of a single parameter in the MAIN set. These slightly altered parameter sets bound the MAIN parameter set on all sides in N-space.

As the system 580 executes and the detection engines filter and decode telemetry data, performance statistics are kept on each of the detection engines (block 802). The supervisor subsystem 558 monitors the performance statistics of the detection engines (block 804) and reconfigures the parameters of the network of detection engines to adapt to the varying conditions of the telemetry environment based on these statistics (block 806). To adapt, the supervisor subsystem 558 will move the values of the MAIN parameters toward the bounding set of parameters that is providing superior performance. Then, the supervisor subsystem 558 will compute new bounding parameter sets for the MAIN parameter set based on the new MAIN values and reconfigure the other detection engines with the new parameter sets.

The incremental value used to change each parameter in the MAIN set to set that parameter value in another detection engine may depend on the nature of the parameter. For example, a filter feedback coefficient may have a smaller percentage change than a signal normalization parameter.

The incremental value may also be proportional to the statistical differences between parameter values. If the statistical difference between parameter values in the MAIN set and the nearest better bounding parameter values in a bounding set is small, then the new MAIN parameter values may only move partially toward the new optimal values.

In some embodiments, a multi-dimensional vector is constructed to adjust the parameter sets. The multi-dimensional vector makes computations to move the parameter sets toward an optimal situation and move it away from an adverse situation. The amount of adaptation of the parameters may be proportional to the statistical advantage of one parameter set over another one. In other embodiments, parameter sets are used that not only bound the MAIN set in one parameter dimension, but also combine parameter changes to bound the MAIN set in multiple dimensions.

Figure 8B:
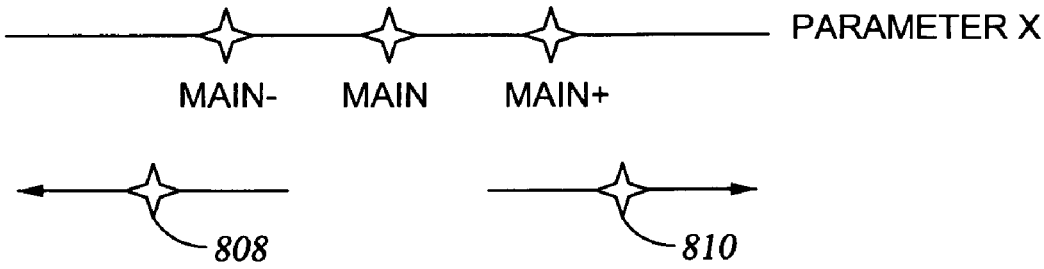
Figure 8C:
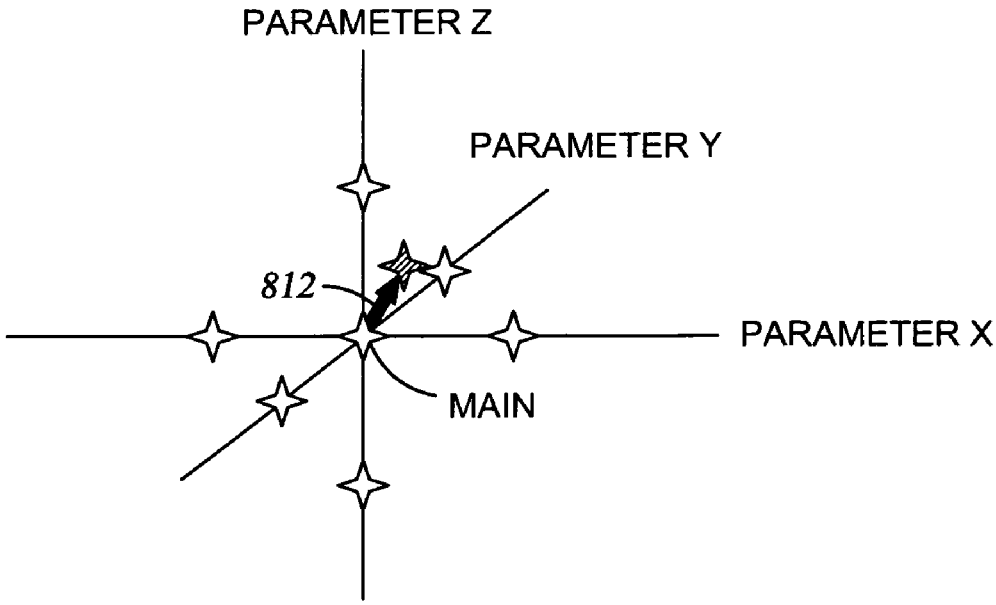
Figure 8D:
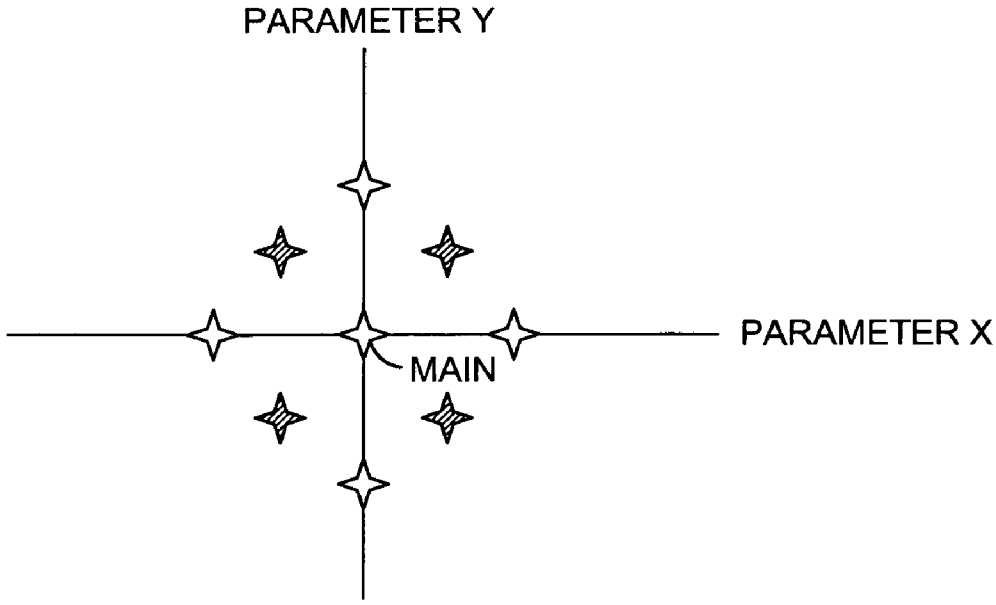

Various adaptation methods in accordance with some embodiments are illustrated by way of example in FIGS. 8B-8D. In the example of FIG. 8B, one parameter controls the decoding of LWD telemetry and three detection engines are used. The supervisor subsystem 558 selects one of these detection engines to be the MAIN detection engine, and configures that engine to have the parameter value X. The supervisor subsystem 558 then configures the other two detection engines such that one, i.e., the MAIN+ engine, has a parameter value of X+ΔX and the other, i.e., the MAIN− engine, has a parameter value of X−ΔX. The parameterized engines are used to filter and decode telemetry data, and performance statistics are compiled for the detection engines.

If the engine MAIN+ (with parameter X+ΔX) performs significantly better than the engine MAIN (with parameter X), then the supervisor subsystem 558 will shift the parameters of the engines in the positive direction 808, with MAIN+=X+2ΔX, MAIN=X+ΔX, and MAIN−=X. If the engine MAIN− (with parameter X−ΔX) performs significantly better than the engine MAIN (with parameter X), then the supervisor subsystem 558 will shift the parameters of the engines in the negative direction 810, with MAIN+=X, MAIN=X−ΔX, and MAIN−=X−2ΔX. If the engine MAIN performs better than both engines MAIN+ and MAIN−, then the supervisor subsystem 558 will not change the parameters of the three engines. The parameter incremental change value (ΔX), the time over which the statistics are compiled, the method by which the performance statistics are derived, and the periodic time when the parameters change may all determine the adaptation rate of the system.

In the example of FIG. 8C, each of seven detection engines has three parameters that control the decoding of LWD telemetry. The values of these three parameters in the engine MAIN are X, Y, and Z. As is shown in Table 1, there are six sets of parameters for each of the other detection engines that bound the MAIN set.

TABLE 1

| Set name | X value | Y value | Z value |
|---|---|---|---|
| SET X+ | X + ΔX | Y | Z |
| SET X− | X − ΔX | Y | Z |
| SET Y+ | X | Y + ΔY | Z |
| SET Y− | X | Y − ΔY | Z |
| SET Z+ | X | Y | Z + ΔZ |
| SET Z− | X | Y | Z − ΔZ |

In one mode, the supervisor subsystem 558 may adapt the system by using the parameter values of the best performing engine to reconfigure the engine MAIN and to shift the parameters of the bounding detection engines incrementally based on the new MAIN parameter values. In another mode, the supervisor subsystem 558 may adapt the system by weighting the performances of the various detection engines and computing a vector 812 toward the optimal parameter set. The adaptation rate, i.e., the length of the vector, may be proportional to the absolute performance of the system. If the system is detecting well (e.g., >97% pulse detection rate), the length of the vector, i.e., the size of the parameter changes, will be small. If the system is detecting poorly (e.g., <70% pulse detection rate), the length of the vector is not limited because a big fix is necessary.

The examples presented thus far, only one parameter value in each of the bounding detection engines differs from a parameter value in the MAIN parameter set. In some embodiments, combination parameter sets may be used in which multiple parameter values in any given detection engine may differ from the corresponding parameter values in the MAIN parameter set. The example of FIG. 8D illustrates combined parameter sets in a system where two parameters control the decoding of LWD telemetry. The values of these two parameters in the engine MAIN are X and Y. In this example, there are eight bounding detection engines, four having parameter sets that bound the MAIN set with changes in only one parameter value, and four having parameters sets that bound the MAIN set with changes in both parameter values. Table 2 illustrates the parameter values for each of the bounding detection engines.

TABLE 2

| Set name | X value | Y value |
|---|---|---|
| SET X+ | X + ΔX | Y |
| SET X− | X − ΔX | Y |
| SET Y+ | X | Y + ΔY |
| SET Y− | X | Y − ΔY |
| SET X+, Y+ | X + ½ ΔX | Y + ½ ΔY |
| SET X+, Y− | X + ½ ΔX | Y − ½ ΔY |
| SET X−, Y+ | X − ½ ΔX | Y + ½ ΔY |
| SET X−, Y− | X − ½ ΔX | Y − ½ ΔY |

By using combination parameter sets, the adaptation to a more optimal parameter set can be more easily identified. For example, consider the example results in Table 3 from using a set of detection parameters as shown in Table 2.

TABLE 3

| Set name | % lists detected | Normalized to MAIN |
|---|---|---|
| MAIN | 92.4% | 1.000 |
| SET X+ | 88.0% | 0.952 |
| SET X+, Y− | 91.6% | 0.991 |
| SET Y− | 93.7% | 1.014 |
| SET X−, Y− | 95.0% | 1.028 |
| SET X− | 92.6% | 1.002 |
| SET X−, Y+ | 89.8% | 0.971 |
| SET Y+ | 86.2% | 0.933 |
| SET X+, Y+ | 84.0% | 0.909 |

From these results, it may be seen that telemetry results may be optimized by changing the parameters in the SET X−, Y− direction. There are several methods to optimize the choice of the adaptation. For example, an ellipsoid can be fit to the outer ring of normalized results, and the MAIN parameter set moved in the direction of the maximum locus. Or, the parameters may be changed by a percentage towards the highest bounding value. In this example, the highest results are those obtained by the SET X−, SET Y− case. With an adaptation percentage parameter of 20%, the new MAIN parameters would be X=X−(0.2*0.5*ΔX), and Y=Y−(0.2*0.5*ΔY).

Another optimization method is to first ensure that there were three bounding parameter sets sequentially related that had results greater than the MAIN parameters. The method would then perform a linear interpolation to determine the best new parameters. In another optimization method, if there are no normalized values greater than 1.000, the statistics are reset, and the ΔX and ΔY values are reduced.

In some embodiments, the supervisor subsystem 558 periodically calculates performance statistics, and makes adjustments to the parameters of the various detection engines, if needed, based on those statistics. For example, the supervisor subsystem 558 may compute performance statistics for every fifty lists decoded, compute new optimal parameters, set the parameters for all of the filtering and detection engines, and reset the statistics after each parameter change. Or, the supervisor subsystem 558 may calculate performance statistics for the last fifty lists detected, but update the statistics results with every list that is detected. Thus, the statistics are calculated for every list detected by keeping a queue of the last fifty lists. New parameters are computed after each list is detected, but delta changes to the filtering and detection parameters are minimized by using a slow adaptation rate.

In one or more embodiments, the supervisor subsystem 558 may use a neural network to make intelligent decisions regarding the filtering and detection parameters. The neural network may monitor the quality of the signal, review frequency spectrum results, review detection statistics, and make recommendations as to parameter changes. In other embodiments, the neural network may directly control the parameters of the detection engines. In other embodiments, the neural network may recommend changes to the telemetry parameters.

In one or more embodiments, if there is a period of time in which it is known that all active detection engines failed to detect a list, the primary detection system can reserve a secondary detection engine for retry capability. In such embodiments, the waveform data has been saved in a queue. The queue is large enough to contain waveform data for several lists before the list that was not detected, and at least one list after the period of no list detection. The primary detection system can reset the secondary detection engine, alter the filtering and detection parameters, and then feed the historical waveform data to the secondary detection engine. If the secondary detection engine detects the previously undetected list, then the list data is passed to the processing system and the secondary detection engine is de-activated. If the secondary detection engine fails yet again to detect the undetected list, then the filtering and detection parameters are altered again, and the historical waveform data is sent again to the secondary detection engine. This process is repeated until either the missing list is detected, or until all possible telemetry combinations are tried.

In some embodiments, the operator previously defines each of the parameter sets to be used in the event of detection failure. In other embodiments, the operator sets high and low limits for each parameter setting and the detection system retries by stepping through each combination. In some embodiments, the detection system keeps track of the results from each retry processing pass and attempts to merge the results to find a solution. In other embodiments, the detection system keeps track of the results from each retry processing pass to determine which trend in changing parameters is yielding better or poorer results; by observing the trends, the system can estimate the values of the best detection parameters for this particular situation.

Certain high amplitude pressure events can occur that disrupt LWD telemetry mainly by destabilizing the filters and detection systems. Following these events, it may take seconds or minutes for filters to recover or reinitialize. In some embodiments, to handle this time delay, the primary detection system waits a few minutes, and then time reverses the raw historical waveforms in the waveform queue. The primary detection system sets up a secondary detection engine to process the information, and then it sends the time-reversed information to the secondary detection engine. The intervals detected by this secondary detection engine are in reverse order, with decreasing time-tags. Once the secondary processing engine has run the signals to the end of the queue, the primary detection system inverts the order of the intervals in the list queue, and attempts to detect lists in the time period for which detection was lost.

Figure 9:
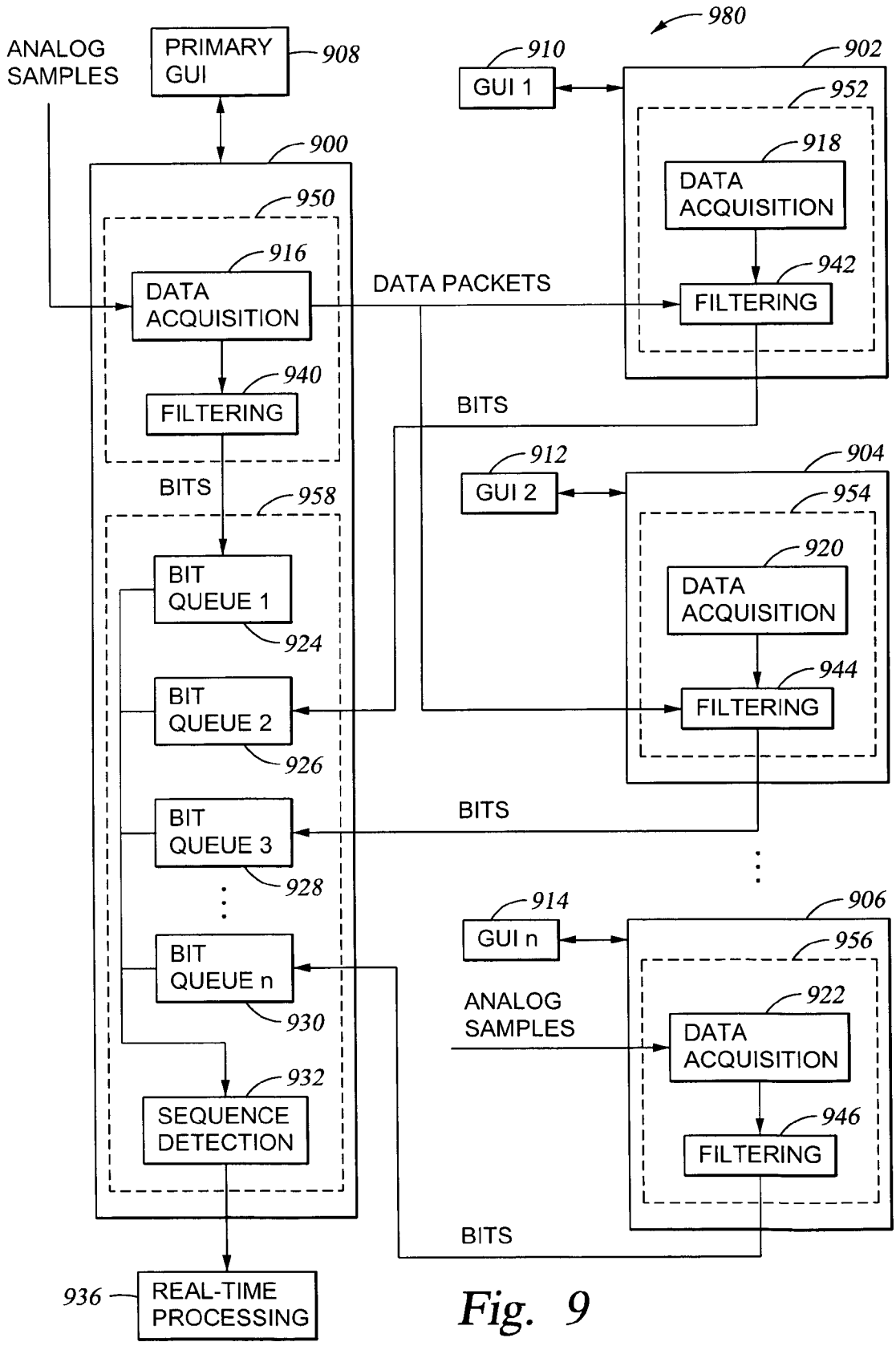

FIG. 9 illustrates a system 980 for detection and filtering of Manchester encoded telemetry data in accordance with one or more embodiments. In Manchester encoding, bits of data are encoded as a sequence with a data transition in the middle. A zero bit value is transmitted with a signal that has a low value for one unit of time, followed by a high value for one unit of time. A one bit value is transmitted with a signal that has a high value for one unit of time, followed by a low value for one unit of time. Thus, two base units of time are needed to transmit either a zero-bit value or a one-bit value. A telemetry receiver uses a transition in the middle of a bit transmission to synchronize the decoding clock, and track the received waveform.

There are two forms of Manchester encoding used in LWD telemetry, asynchronous and synchronous. In asynchronous Manchester encoding, a synchronizing start cell precedes the telemetry data cells and has a different frequency than the data cells. The start cell may be three times longer in duration than the data cells. Each asynchronous data packet may include a start cell, some predefined number of data cells, and a checksum cell. In some LWD applications, the data cells begin with a number of identification bits that identify the type of the data sequence to follow. The types of the data sequences to be transmitted as well as the expected ordering of the telemetry data in a data sequence type and the cell count for each type of telemetry data (e.g., resistivity, gamma ray reading, and density value) are predefined. The identification bits are followed by encoded parameter values associated with the data sequence identifier. The encoded parameter values are followed by a sufficient number of checksum bits to ensure error-free reception of the data.

In some embodiments, synchronous Manchester encoding includes flag sequences, tag sequences, and data sequences. In addition, each data sequence may include a checksum or parity bits, or a set of data sequences may include a checksum or parity bits. A flag sequence, which may be a unique characteristic sequence of data values that do not otherwise occur in normal telemetry data, is used to synchronize the decoding process. The flag sequence can be any pattern of N bits as long as the pattern is not a sequence of all 0 values or all 1 values. This restriction exists because it is difficult for a flag sequence decoder to tell the difference between the pattern 1111111 and 0000000.

Following the flag sequence is an identification or tag sequence of M bits. The identification bits identify the format of the data that will follow. Cyclic data transmission then follows in which the same data sequence is transmitted repeatedly until either a maximum transmission time limit is reached or a different type of data sequence is to be transmitted. The maximum transmission time limit is used to re-synchronize the Manchester decoder in the event of a bit detection loss. During data sequence transmission, if the N−1 data bits (or less) match the pattern of a flag sequence, then the next data bit will be a pad bit of the value opposite the Nth flag sequence bit to denote that the data sequence is not a flag sequence. For example, in some embodiments of synchronous Manchester encoding, the flag sequence is the binary value 01111110. The sequence identifier can be any 5-bit value. When a data stream contains the pattern of 011111 ("zero", followed by five "ones"), a 0 pad bit is inserted to differentiate it from the flag sequence.

The use of synchronous and asynchronous Manchester encoding places different requirements on a system receiving and decoding the encoded telemetry data. If asynchronous Manchester encoding is used, the input filtering may need to be broader in frequency that required for synchronous Manchester encoding because the start cell is of a different frequency than the other cells. Also, a start cell decoder that runs in parallel with the data cell decoder is required to support the use of asynchronous Manchester encoding, while a single data cell decoder is sufficient to support the use of synchronous Manchester encoding.

A number of algorithms for detecting Manchester encoded data cells are known in the art. One such algorithm may be a software implementation of the Manchester decoder described in U.S. Pat. No. 4,361,895 entitled "Manchester Decoder." Other Manchester decoder algorithms include two elements that work together. The first element is a synchronization process that searches for and locks onto the regular signal transitions that occur in the mid-point of a data cell. The other decoder element decodes the data value contained in the data cell. Two common methods to decode the cell are to measure the slope of the mid-cell transition (down=data "1", up=data "0"), or to sample the signal values at the ¼ and ¾ cell positions and perform a comparison of the values to determine the data value encoded, where the sampling position is determined by the mid-cell synchronizer. Another algorithm uses a state machine that samples data at 12× or 6× the data rate of the Manchester encoded signal. A state machine of such a design can adaptively lock onto the mid-cell transition as it decodes the data values. Each of these algorithms has benefits and deficiencies, and differing probabilities for success as drilling conditions change. The decoding and data sequence detection performance of a system using Manchester decoding, either synchronous or asynchronous, may be enhanced by applying multiple of these algorithms to the encoded telemetry data concurrently, and merging the results.

Referring now to FIG. 9, the system 980 includes at least a primary detection system 900 and may include one or more secondary detection systems 902-906 in communication with the primary detection system 900. Each of the detection systems 900-906 has an associated graphical user interface ("GUI") 908-914. One or more detection engines 950-956 execute on the detection systems 900-906. Each of the detection engines 950-956 includes a data acquisition subsystem 916-922 and a filtering subsystem 940-946. The primary detection system 900 also includes a supervisor subsystem 958. The supervisor subsystem 958 includes one or more bit queues 924-930 corresponding to the one or more detection engines 950-956, and a list detection subsystem 932. The system 980 also includes a real-time processing system 936.

The data acquisition subsystem 916 includes functionality to receive analog samples from the pressure sensing devices 30 and to provide waveforms to the filtering functionality 940. The data acquisition subsystem 916 may also include functionality to provide packets of waveforms to the filtering subsystems of one or more of the detection engines executing on the secondary detection systems.

In various embodiments, the detection engines may be configured either to receive packets of waveforms from a data acquisition subsystem on the primary detection system or to receive analog samples directly from the pressure sensing devices via a data acquisition subsystem included in the detection engine. In the illustrated embodiment, the detection engines 952 and 954 are configured to receive waveform data packets from the data acquisition subsystem 916 of the detection engine 950 on the primary detection system 900. The detection engine 956 on the secondary computing system 906 is configured to receive analog samples directly from the pressure sensing devices 30 via the data acquisition subsystem 922.

In each of the detection engines 950-956, the received waveforms are provided to the filtering subsystems 940-946. The filtering subsystems 940-946 contain functionality to apply a series of parameterized filtering and detection algorithms to each waveform in an attempt to detect the Manchester data cell and determine the bit value. The resulting detected bits are provided to the respective bit queues 924-930.

The filtering subsystems 940-946 use identical filtering algorithms. That is, the filtering subsystems 940-946 each include the same parameterized filtering algorithms, and these filtering algorithms are applied to the waveforms in the same order. In each filtering subsystem 940-946, the output of the filtering algorithms is provided to a parameterized data cell (i.e., bit value) detection algorithm. In some embodiments, a different data cell detection algorithm may be used in each of the detection engines 950-956. In other embodiments, two or more detection engines may use the same data cell detection algorithm while others use different data cell detection algorithms. In some embodiments, three different Manchester decoding algorithms are used.

The resulting detected bits are provided to the bit queue 924-928 in the primary detection system 900 that corresponds to the detection engine 950-956. That is, bits detected by the filtering subsystem 940 of the detection engine 950 are provided to the bit queue 924, bits detected by the filtering subsystem 942 of the detection engine 952 are provided to the bit queue 926, and so on.

Embodiments of the sequence detection subsystem 932 include functionality to merge the outputs of the detection engines to detect data sequences and to collect performance statistics on each of the detection engines. In some embodiments, the merging of the outputs is done as follows. The sequence detection subsystem 932 decodes the output of each detection engine separately. That is, the sequence detection subsystem 932 concurrently applies sequence detection algorithms to each bit queue 924-930 to attempt to detect a data sequence. When a data sequence is decoded from any of the bit queues 924-930, the results are passed to a sequence arbitration algorithm. If an identical data sequence is detected from each of the bit queues 924-930, this sequence arbitration algorithm ensures that only one copy of the data sequence is passed to the real-time processing subsystem 936. In some embodiments, if an identical data sequence is not detected from each of the bit queues 924-930, the sequence arbitration algorithm may not accept any of the decoded sequences. In other embodiments, the sequence arbitration algorithm may select the data sequence that was determined from a majority of the bit queues 924-930 to be passed to the real-time processing subsystem 936. If there is no data sequence determined from a majority of the bit queues 924-930, the sequence arbitration algorithm may accept the solution that matches the parity associated with the data item. If multiple data sequences have correct parity, the algorithm may look at the telemetry history to choose the solution whose value is closest to the data item that was previously transmitted. For example, if there are two 8-bit binary solutions representing gamma ray counts that have correct parity and their numbers are 140 (binary 10001100) and 28 (binary 00011100), and the previous number transmitted for gamma ray was 137, then the algorithm can choose 140 as being the correct value with a fair degree of certainty.

In other embodiments of the sequence detection subsystem 932, the outputs of the detection engines 950-956 are merged by combining the binary data outputs to form one data stream to which the sequence detection algorithms are applied. That is, for each cell in a data sequence, the sequence detection subsystem 932 looks at the corresponding decoded bit value in each bit queue 924-930. If the bit value is the same in each bit queue, that value is used in the data stream. If the bit value is not the same, a bit value may be selected based on a voting mechanism or a weighting scheme. For example, the bit value that appears in the majority of the bit queues may be selected. Or, a weighting value may be assigned to the outputs of each decoding engine and the bit value with the highest weight may be selected. Any decoding engine whose output disagrees with the majority may be disabled until the next start cell (for asynchronous Manchester encoding) or initiating zero value data cell sequence (for synchronous Manchester encoding) is detected.

In yet other embodiments of the sequence detection subsystem 932, a combination of the above two methods of merging the outputs of the detection engines 950-956 is used.

The sequence detection subsystem 932 also contains functionality to generate and/or store statistical information regarding the performance of the detection engines 950-956. In some embodiments, the sequence detection subsystem 532 records for each detection engine at least the total number of bits detected (i.e., the number of bits received in the bit queue associated with a detection engine), the number of bits successfully decoded into sequences, and the percentage of bits successfully decoded into sequences. These performance statistics may be displayed using the graphical user interface 908.

The real-time processing subsystem 936 and the GUIs 908-914 include functionality similar to that of the real-time processing subsystem 536 and the GUIs 508-514 described in reference to FIG. 5A and FIGS. 7A-7I above. In some embodiments, the operator initially configures each detection engine by setting the parameters of the filtering and bit detection algorithms. The filtering parameters may be selected so that as least some of these parameters are different in each detection engine. In at least one embodiment, the operator may initialize the detection engines from a database by choosing sets of parameters that are most similar to the anticipated job conditions. In other embodiments, the operator may initialize the parameters of the different detection engines to optimize detection for specific drilling activities, such has normal drilling, high weight-on-bit, circulating, steering the hole with a tight turn, reaming the hole, etc. As the system 980 operates, the operator may monitor the detection performance of the detection engines by displaying performance statistics, and may change the filtering and detection parameters of one or more of the detection engines to optimize telemetry in response to changing drilling conditions (e.g., increasing density and/or viscosity of the drilling fluid, increasing depth, or changes in the propagation speed of the wave shape through the drilling fluid).

In some embodiments, the supervisor subsystem 958 automatically configures and controls the network of detection engines in a manner similar to that of supervisor subsystem 558 as described with reference to FIG. 5A and FIGS. 8A-8D. In some embodiments, the filtering and detection subsystems 940-946 include a high-pass filter with a cutoff frequency at least a decade below the lowest Manchester frequency component, an adjustable FIR filter that may be configured as low-pass, high-pass, band-pass, or notch, and two different pump noise reduction filters. The signal output of these filters feed into the Manchester decoding algorithm included in the filtering and detection subsystem. Some embodiments use three different Manchester decoding algorithms, each used in at least one of the filtering and detection subsystems. In some embodiments, many of the filtering algorithms are similar or identical to the filtering algorithms described in relation to FIG. 5B. The methods described in reference to FIGS. 8A-8D may be used in various embodiments to adapt the filtering parameters in each of the detection engines.

In some embodiments of the telemetry system, functionality is included to support recovery from system failures such as failure of the primary detection system, a secondary detection system, or network communication failures. In some embodiments, the configurations of the primary and secondary detection systems are stored in the centralized database (e.g., the Logging Database System 204 of FIG. 2) or some other centralized location. If the primary detection system fails, one of the secondary detection systems can be promoted to become a new primary detection system. In some embodiments, the secondary detection system whose configuration is stored first after the primary can auto-promote itself to be the new primary detection system. Because the detection engines on the secondary detection systems communicate their outputs to the primary detection system, a secondary detection system can know that the primary detection system has failed if outputs fail to transfer to the queues of the primary detection system. In some embodiments, the secondary detection systems wait for a predetermined time period before deciding that the primary detection system has failed to allow for a temporary failure of the primary detection system.

In at least some embodiments, a monitor application executes on each computer system in the telemetry system. When an application designed for continuous operation starts, the application registers itself with the monitor application; when the application terminates normally, it de-registers itself with the monitor application. The monitor application serves multiple purposes. If the operator decides to shut a computer down, the monitor application can shut down all registered applications in an orderly fashion before turning off background services applications. The monitor application periodically sends a query to all registered applications. If an application does not respond, and the monitor application determines that the application is no longer running or resident in memory, the monitor application restarts the application. If the application does not respond but still shows as running, the monitor application assumes the application is locked-up or has otherwise abnormally stopped functioning, and kills and restarts the application.

The primary and secondary detection systems are monitored by the monitor application. If a primary detection system application crashes (aborts abnormally) or locks up, the monitor application restarts the primary detection system. In such embodiments, the secondary detection systems are designed to buffer information and re-establish network communications in the event of communications loss with the primary detection system. If the primary detection system does not respond to communications from a secondary detection system within a predefined time period (e.g., the time required for the application to be identified, killed and restarted), the primary detection system computer is assumed to be non-functional.

In various embodiments, the monitor application also monitors the secondary detection systems. If a secondary detection system becomes temporarily non-functional due to an abnormal termination, a lock-up, or some other failure that does not otherwise affect the computer that the secondary detection system is running on, the monitor application restarts the secondary detection system. The primary detection system may also buffer data and re-establish network communications in the event of a communications loss with a secondary detection system. If a secondary detection system does not respond to communications from the primary detection system within a predefined time period (e.g., the time required for the secondary detection system application to be identified, killed and restarted), the monitor application assumes that the secondary detection system computer is non-functional. In some embodiments, when the primary detection system is determined to be non-functional, one or more of the secondary detection systems signal alarms to alert the operator that a failure has occurred.

In other embodiments, when the primary detection system is determined to be non-functional, the top-most computer in the secondary detection system configuration list becomes the primary detection system. Alternatively, the operator designates which computer is to be the backup to the primary detection system. The monitoring application also updates the configuration file stored in the database to disable the former primary detection system. The disablement ensures that the former primary detection system cannot attempt to take control of the new primary detection system should the failure of the former primary detection be temporary. The secondary detection system then promotes itself to be the new primary.

The new primary detection system communicates with the remaining secondary detection systems to cause them to re-read their configuration settings and determine that there is a new primary detection system. The new primary detection system determines the data sources that were being used and are still available. If the former primary detection system did not actually perform data acquisition, then the new primary detection system establishes a link to the data source and begins distributing data to the detection engines. If the former primary detection system was performing data acquisition and distributing the waveform data, then the new primary detection system will determine a new source of waveform data, write the new configuration settings, and begin normal operations. In other embodiments, the new primary detection system asks the operator to specify a new data source. In some embodiments, if the former primary detection system comes back on-line, its configuration parameters are set to configure it as a secondary detection system.

In some embodiments, secondary detection systems announce their presence when they are configured, or when they start up. The database maintains a list of active and operational secondary detection systems. When a secondary detection system starts up, it adds its name to the list. If, during normal operation, a primary detection system senses the failure of a secondary detection system, the primary removes the secondary detection system name from the active list.

The use of such a database system allows the primary and secondary detection systems to recover from a power fail condition in any order. Consider a case in which power fails to all of the computers in the multi-detection system. When power is returned, the computers power up. In some embodiments, the computers automatically start background services in the correct sequence. Then the applications that were running when power failed are restarted. Note that all of this application information was registered with the monitor application, and the restart functionality uses the previous running application information to startup the appropriate programs.

On power-up, the list of active secondary detection systems is automatically cleared. As each secondary detection system starts, it adds its name back to the active secondary detection system list. As the primary detection system starts, it reads the list of secondary detection systems to determine which detection engines are on-line and ready to run. In various embodiments, as new secondary detection systems come back on-line after the primary, the primary detection system determines their presence by receiving a database notification that the record containing the list of active secondary detection systems has been updated. In some embodiments, the primary detection system subscribes to the database record containing the list of active secondary detection systems, and thus receives a copy of any record modifications as new secondary detection systems come on-line. In other embodiments, the primary detection system periodically polls the record containing the list of active secondary detection systems to determine if any new systems have joined the list. In any case, the order of recovery of the primary and secondary detection systems from a power fail condition does not affect the restart.

In other embodiments, the primary detection system seeks out and finds unused secondary detection systems on the network. When the operator on the primary computer selects a secondary detection system to be part of his multi-detection network, the computer name of the primary detection system is saved on the secondary detection system computer in a local file. The primary detection system also saves the names of all of its external secondary detection systems in a local file. Following computer restart after a power fail event, the primary detection system clears its list of secondary detection system computers. As the secondary detection systems start, they communicate their "ready" status to the primary detection system computer. For each "ready" status from a secondary, the primary detection system adds the secondary detection system computer name back to its list, and begins to use it for multi-detection.

In other embodiments, the primary detection system keeps its list of secondary detection system computers following restart, and attempts to re-establish communication with these computers until a timeout limit is reached. Once the timeout limit is reached, the unresponsive secondary detection system computer name is removed from the file stored on the primary detection system computer.

In some embodiments, all information stored on the main logging database is replicated onto the backup logging database. The word "replicated" is used instead of "copied" because all application access to data is through the database application interface. The physical storage of the records in the database may differ between databases, even though identical information is obtained via database queries. In the event of a main logging database failure, the backup logging database can sense this failure. The backup logging database senses this failure when the network communications link between it and the main logging database fails; the network communication link is used for the replication of data. In some embodiments, the backup logging database sends an alarm to notify the operator of the failure.

In other embodiments, the backup logging database promotes itself to be the main logging database. The backup logging database announces its promotion to all database client interfaces that were previously connected to the main logging database. Applications then transfer database operations to the new database. In some embodiments, the backup logging database delays its promotion by the period of time it would estimate for the main logging database computer to reboot and restart the database; this allows the main database a chance to recover from the event that caused it to fail. In other embodiments, the backup logging database immediately takes over main logging database responsibilities as soon as a failure is detected. The primary detection system and the real-time processing system automatically detect the switchover to the backup logging database.

Figure 10:
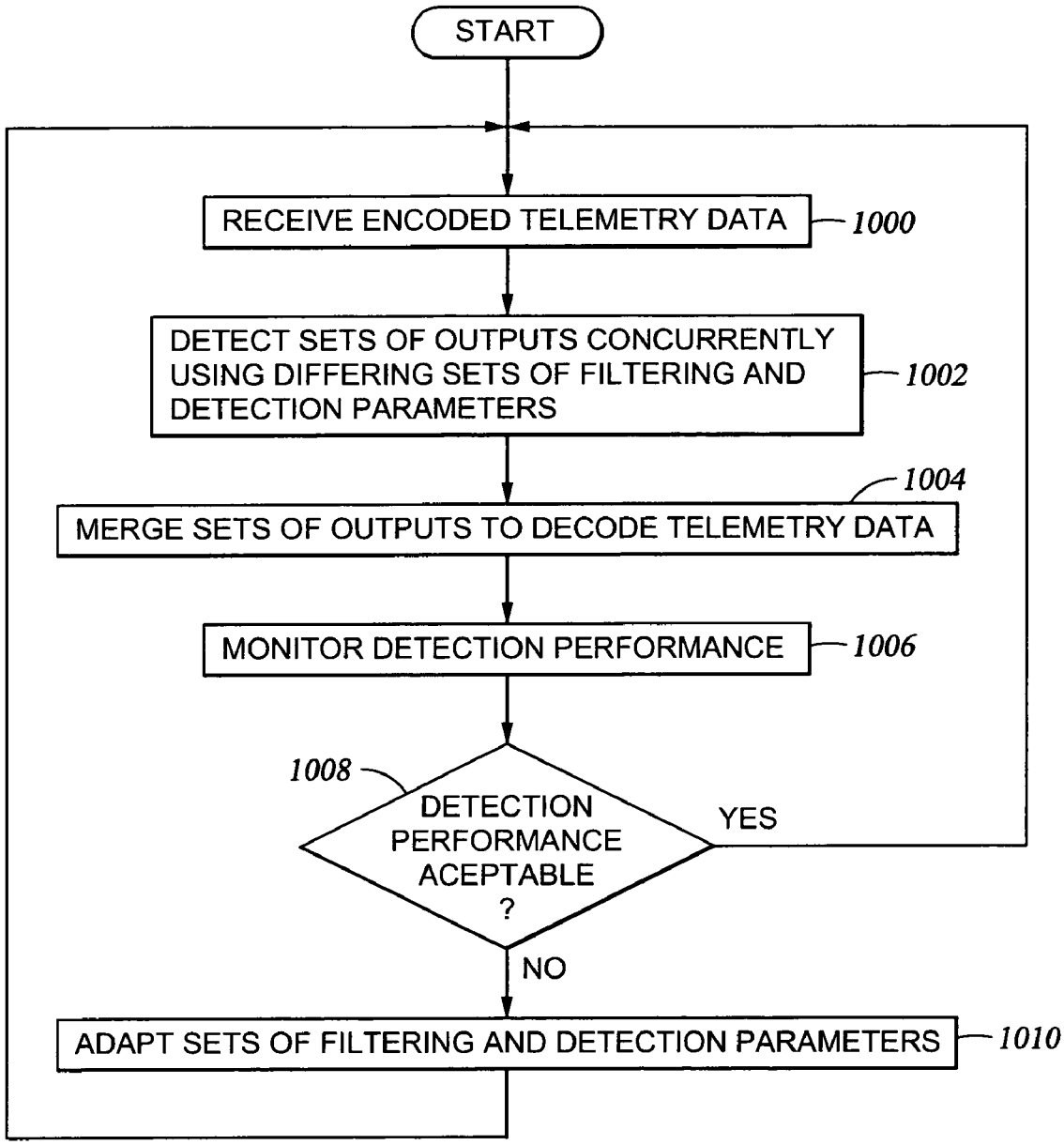
FIG. 10 shows an illustrative method for filtering and detection of telemetry in accordance with one or more embodiments.

FIG. 10 is a flow graph of a method for filtering, detecting, and decoding telemetry data in accordance with one or more embodiments. Although the actions of this method are presented and described serially, the order may differ and/or some of the actions may occur in parallel without departing from the scope and spirit of invention. Encoded telemetry data is received (block 1000) and at least two sets of filtering and detection parameters are used concurrently to detect at least two sets of outputs from the encoded telemetry data (block 1002). In some embodiments, at least some of the parameter values in each set of filtering and detection parameters are different. The sets of outputs are then merged to decode the encoded telemetry data (block 1004). As encoded telemetry data is received and decoded, detection performance is monitored (block 1006). That is, the efficacy of the sets of filtering and detection parameters in detecting outputs is monitored. If overall detection performance is acceptable (block 1008) (i.e., the encoded telemetry data is being successfully decoded), receipt and decoding of encoded telemetry data continues with the same sets of filtering and detections parameters (blocks 1000-1006). If overall detection performance is not acceptable, the values of parameters in the sets of filtering and detection parameters are adapted to improve the detection performance (block 1010). Receipt and decoding of the encoded telemetry data continues with the new parameter values.

There are several LWD and MWD applications that can benefit from multi-detection systems and methods such as those described herein. For example, conditions can change in the downhole equipment such that a major change in telemetry parameters is required. In the case of battery powered downhole equipment, the power output from the batteries may drop such that current telemetry rates cannot be sustained. In this case, the downhole system may be programmed to slow transmission by 50% in order to accommodate the reduced power capacity. The surface detection system may allocate one secondary detection engine with a set of parameters configured to detect the power-saving pressure signal transmission. In this manner, the downhole instrumentation does not have to transmit status information informing the surface of a transmission change; the downhole system can immediately change transmission rates with the assurance that the surface system will detect the change without any interruption in detection and processing of data. Or, the downhole instrumentation may detect a change in the formation properties that is of interest to the geologists or log analysts. The downhole system may then change the telemetry parameters to support a much faster telemetry rate, in order to transmit the higher density data that is desired for this region of the well. One of the secondary detection engines can be configured for the faster telemetry rate, and will automatically pick up detection when the downhole system switches to the faster telemetry rate. This allows for an automatic, seamless switchover to the faster telemetry rate without requiring the downhole system to send status notification of the rate change.

The above discussion is meant to be illustrative of the principles and various embodiments of the present invention. Numerous variations and modifications will become apparent to those skilled in the art once the above disclosure is fully appreciated. For example, other embodiments may include the ability to process more than two waveforms comprising the encoded telemetry data. In addition, the methods and systems described herein may be used for QSPK (Quadrature-Phase-Shift-Keying), QAM (Quadrature-Amplitude-Modulation), or any permutation of phase and amplitude modulation encoding/decoding methods that are used in the logging while drilling industry. The methods and systems may also be used for electro-magnetic telemetry and acoustic telemetry. It is intended that the following claims be interpreted to embrace all such variations and modifications.

What is claimed is:

1. A method comprising:

receiving a plurality of waveforms comprising encoded telemetry data, the receiving further comprising receiving the encoded telemetry data transmitted by way of drilling fluid in a drilling string;

detecting a first set of outputs from the encoded telemetry data using a first set of filtering and detection parameters;

detecting a second set of outputs from the encoded telemetry data using a second set of filtering and detection parameters, at least some of the second set of filtering and detection parameters different from the first set of filtering and detection parameters, and the detecting the second set of outputs substantially concurrent with detecting the first set of outputs; and merging the first set of outputs and the second set of outputs to produce decoded telemetry data.

2. The method of claim 1, wherein merging the first set of outputs and the second set of outputs further comprises:

combining portions of the first set of outputs and the second set of outputs to produce a combined set of outputs; and using the combined set of outputs to produce decoded telemetry data.

3. The method of claim 1, wherein merging the first set of outputs and the second set of outputs further comprises:

using the first set of outputs to produce a first set of decoded telemetry data;

using the second set of outputs to produce a second set of decoded telemetry data; and sending one of the first set of decoded telemetry data and the second set of decoded telemetry data for further processing.

4. The method of claim 3, wherein merging the first set of outputs and the second set of outputs further comprises:

combining portions of the first set of outputs and the second set of outputs to produce a combined set of outputs; and using the combined set of outputs to produce a third set of decoded telemetry data; and wherein sending further comprises sending one of the first set of decoded telemetry, the second set of decoded telemetry data, and the third set of decoded telemetry data for further processing.

5. The method of claim 3, further comprising:

determining whether the first set of decoded telemetry data and the second set of decoded telemetry data are consistent;

applying selection criteria to determine a possibly coffect set of decoded telemetry data if the first and second sets of decoded telemetry data are not consistent; and sending the possibly correct set of decoded telemetry data for further processing.

6. The method of claim 1, further comprising:

computing performance statistics for the first set of filtering and detection parameters;

computing performance statistics for the second set of filtering and detection parameters; and adapting at least one parameter value of the first and second sets of filtering and detection parameters responsive to the computed performance statistics.

7. The method of claim 6, wherein adapting the values further comprises adapting the at least one parameter value automatically.

8. The method of claim 6, further comprising:

detecting a third set of outputs from the encoded telemetry data using a third set of filtering and parameters; and computing performance statistics for the third set of filtering and detection parameters;

and wherein adapting at least one parameter value further comprises:

determining which of the sets of filtering and detection parameters has better performance statistics;

changing the second set of filtering and detection parameters to match the filter and detection parameters with the better performance statistics; and changing the first and third sets of filtering and detection parameters to differ from each other, and from the second set of filtering and detection parameters.

9. The method of claim 6, wherein the adapting is performed by a neural network.

10. The method of claim 1, further comprising:

setting parameter values of the first and second sets of filtering and detection parameters, at least some of the parameter values differing in each set.

11. A telemetry system comprising:

a bottomhole assembly that transmits encoded telemetry data to the surface by way of drilling fluid in a drilling string;

at least one sensing device that detects the encoded telemetry data; and a surface system coupled to the at least one sensing device, the surface system acquires the encoded telemetry detected by the at least one sensing device, and the surface system detects a first set of outputs from the encoded telemetry data using a first set of filtering and detection parameters, detects a second set of outputs from the encoded telemetry data using a second set of filtering and detection parameters, at least some of the second set of filtering and detection parameters different from the first set of filtering and detection parameters, and the detecting the second set of outputs substantially concurrent with detecting the first set of outputs, and merges the first set of outputs and the second set of outputs to produce decoded telemetry data.

12. The telemetry system of claim 11 wherein the surface system further comprises a plurality of computer systems, a first computer system of the plurality of computer systems executing a first detection engine comprising the first set of filtering and detection parameters and a second computer system of the plurality of computer systems executing a second detection engine comprising the second set of filtering and detection parameters.

13. The telemetry system of claim 11 wherein the surface system comprises a plurality of detection engines on the same computer system, each software program detects attributes of the encoded telemetry data, a first detection engine of the plurality of detection engines comprising the first set of filtering and detection parameters and a second detection engine of the plurality of detection engines comprising the second set of filtering and detection parameters.

14. The telemetry system of claim 11, wherein when the surface system merges the first and second set of outputs, the surface system combines portions of the first set of outputs and the second set of outputs to produce a combined set of outputs, and uses the combined set of outputs to produce decoded telemetry data.

15. The telemetry system of claim 11, wherein when the surface system merges the first and second set of outputs, the surface system uses the first set of outputs to produce a first set of decoded telemetry data;

uses the second set of outputs to produce a second set of decoded telemetry data; and sends one of the first set of decoded telemetry and the second set of decoded telemetry data for further processing.

16. The telemetry system of claim 15, wherein when the surface system merges the first and second set of outputs, the surface system combines portions of the first set of outputs and the second set of outputs to produce a combined set of outputs; and uses the combined set of outputs to produce a third set of decoded telemetry data; and the surface system further sends one of the first set of decoded telemetry, or the second set of decoded telemetry data, or the third set of decoded telemetry data for further processing.

17. The telemetry system of claim 15, wherein the surface system further determines whether the first set of decoded telemetry data and the second set of decoded telemetry data are consistent;

applies selection criteria to determine a possibly correct set of decoded telemetry data if the first and second sets of decoded telemetry data are not consistent; and sends the possibly correct set of decoded telemetry data for further processing.

18. The telemetry system of claim 11, wherein the surface system further computes performance statistics for the first set of filtering and detection parameters;

computes performance statistics for the second set of filtering and detection parameters; and adapts at least one parameter value of the first and second sets of filtering and detection parameters responsive to the computed performance statistics.

19. The telemetry system of claim 18, wherein the surface system further adapts the at least one parameter value automatically.

20. The telemetry system of claim 18, wherein the surface system further:

detects a third set of outputs from the encoded telemetry data using a third set of filtering and parameters; and computes performance statistics for the third set of filtering and detection parameters; and the surface system further adapts at least one parameter value, when the surface system adapts, the surface system:

determines which of the sets of filtering and detection parameters has better performance statistics;

changes the second set of filtering and detection parameters to match the filter and detection parameters with the better performance statistics; and changes the first and third sets of filtering and detection parameters to differ from each other, and from the second set of filtering and detection parameters.

21. The telemetry system of claim 18, wherein the surface system further adapts at least one parameter using a neural network.

22. The telemetry system of claim 11, wherein the surface system further sets parameter values of the first and second sets of filtering and detection parameters, at least some of the parameter values differing in each set.

23. A computer-readable medium storing a program that, when executed in a telemetry system, cause the telemetry system to:

receive a plurality of waveforms comprising encoded telemetry data, the encoded telemetry data transmitted by way of drilling fluid in a drilling string;

detect a first set of outputs from the encoded telemetry data using a first set of filtering and detection parameters;

detect a second set of outputs from the encoded telemetry data using a second set of filtering and detection parameters, at least some of the second set of filtering and detection parameters different from the first set of filtering and detection parameters, and the telemetry system detects the second set of outputs substantially concurrent with the first set of outputs; and merge the first set of outputs and the second set of outputs to produce decoded telemetry data.

24. The computer-readable medium of claim 23, wherein when the telemetry system merges, the program causes the telemetry system to combine portions of the first set of outputs and the second set of outputs to produce a combined set of outputs; and use the combined set of outputs to produce decoded telemetry data.

25. The computer-readable medium of claim 23, wherein when the telemetry system merges, the program causes the telemetry system to use the first set of outputs to produce a first set of decoded telemetry data;

use the second set of outputs to produce a second set of decoded telemetry data; and send one of the first set of decoded telemetry data and the second set of decoded telemetry data for further processing.

26. The computer-readable medium of claim 25, wherein when the telemetry system merges, the program causes the telemetry system to combine portions of the first set of outputs and the second set of outputs to produce a combined set of outputs; and use the combined set of outputs to produce a third set of decoded telemetry data; and when the telemetry system sends, the program causes the telemetry system to send one of the first set of decoded telemetry, the second set of decoded telemetry data, and the third set of decoded telemetry data for further processing.

27. The computer-readable medium of claim 25, wherein when the telemetry system merges, the program causes the telemetry system to determine whether the first set of decoded telemetry data and the second set of decoded telemetry data are consistent;

apply selection criteria to determine a possibly correct set of decoded telemetry data if the first and second sets of decoded telemetry data are not consistent; and send the possibly coffect set of decoded telemetry data for further processing.

28. The computer-readable medium of claim 23 wherein the program further causes the telemetry system to:

compute performance statistics for the first set of filtering and detection parameters;

compute performance statistics for the second set of filtering and detection parameters; and adapt at least one parameter value of the first and second sets of filtering and detection parameters responsive to the computed performance statistics.

29. The computer-readable medium of claim 28, wherein when the telemetry system adapts, the program causes the telemetry system to adapt the at least one parameter value automatically.

30. The computer-readable medium of claim 28, wherein the program further causes the telemetry system to:

detect a third set of outputs from the encoded telemetry data using a third set of filtering and parameters; and compute performance statistics for the third set of filtering and detection parameters; and when the telemetry system adapts, the program causes the telemetry system to determine which of the sets of filtering and detection parameters has better performance statistics;

change the second set of filtering and detection parameters to match the filter and detection parameters with the better performance statistics; and change the first and third sets of filtering and detection parameters to differ from each other, and from the second set of filtering and detection parameters.

31. The computer-readable medium of claim 28, wherein when the telemetry system adapts, the program causes the telemetry system to comprise a neural network.

32. The computer-readable medium of claim 23, wherein the program further causes the telemetry system to set parameter values of the first and second sets of filtering and detection parameters, at least some of the parameter values differing in each set.

33. The method of claim 1 wherein receiving further comprising receiving the encoded telemetry data transmitted by inducing pressure pulses in the drilling fluid in the drilling string.

34. The telemetry system of claim 11 wherein the at least one sensing device detects the encoded telemetry data transmitted by pressure pulses induced in the drilling fluid in the drilling string.

35. The computer-readable medium of claim 23 wherein when the telemetry system receives, the program causes the telemetry system to receive the encoded telemetry data transmitted by pressure pulses induced in the drilling fluid in the drilling string.

* * * * *